United States Patent [19]

Hasegawa et al.

[11] 4,266,324

[45] May 12, 1981

[54] SILVER WEIGHT UNEVENNESS CORRECTING APPARATUS

[75] Inventors: Junzo Hasegawa, Obu; Susumu Kawabata, Aichi; Hiroshi Niimi; Yasuhiko Suzuki, both of Nagoya; Masaki Akatsuka, Kariya; Takahiko Tsunekawa, Aichi, all of Japan

[73] Assignees: Kabushiki Kaisha Toyota Chuo Kenkyusho, Nagoya; Kabushiki Kaisha Toyoda Jidoshokki Seisakusho, Kariya, both of Japan

[21] Appl. No.: 107,571

[22] Filed: Dec. 27, 1979

[30] Foreign Application Priority Data

| | | | |
|---|---|---|---|
| Dec. 27, 1978 | [JP] | Japan | 53-163856 |
| Jan. 24, 1979 | [JP] | Japan | 54-7966 |
| Feb. 9, 1979 | [JP] | Japan | 54-14605 |
| Feb. 15, 1979 | [JP] | Japan | 54-16905 |

[51] Int. Cl.[3] ..... D01H 5/38

[52] U.S. Cl. ..... 19/239

[58] Field of Search ..... 19/236, 239, 240, 0.2; 226/25, 26, 29, 42, 43, 44, 45

[56] References Cited

U.S. PATENT DOCUMENTS

| | | | |
|---|---|---|---|
| 2,811,753 | 11/1957 | Whitehurst | 19/236 X |
| 3,203,051 | 8/1965 | Whitehurst | 19/239 |
| 3,444,594 | 5/1969 | Whitehurst | 19/239 |
| 4,100,649 | 7/1978 | Erismann et al. | 19/0.2 |
| 4,167,803 | 9/1979 | Teichmann | 19/0.2 |

*Primary Examiner*—Louis Rimrodt

*Attorney, Agent, or Firm*—Oblon, Fisher, Spivak, McClelland & Maier

[57] ABSTRACT

Sliver weight unevenness correcting apparatus of a feed-forward type has: a sliver weight measuring section for detecting the variations in weight of a bundle of slivers; a correcting draft device having front rollers disposed downstream of the sliver weight measuring section relative to the direction of advancement of slivers, the front rollers being rotated at a constant speed, and back rollers disposed between the sliver weight measuring section and the front rollers, the back rollers being rotated at a variable speed; a rotation detector for detecting the number of revolutions of the front rollers; an unevenness correcting circuit having a ratio circuit for operating a ratio ($E_0/E_1$) between a reference sliver weight ($E_0$) and the detected weight ($E_1$) thereof, a delay circuit for delaying the speed control of the back rollers of the correcting draft device for a predetermined period of time, and a contrasting operational circuit for multiplying the ratio ($E_0/E_1$) and a ratio ($N_F/k$) between the number ($N_F$) of revolutions of the front rollers and a reference draft value (k) and for producing a multiplied signal ($E_0/E_1 \cdot N_F/k$); and a speed control circuit for producing a speed control signal responsive to the multiplied signal to control the speed of back rollers through a rotation transmitting mechanism. This arrangement enables accurate correction of sliver weight unevenness even short in wavelength in a drawing frame running at a high speed.

30 Claims, 18 Drawing Figures

SILVER WEIGHT UNEVENNESS CORRECTING APPARATUS

BACKGROUND OF THE INVENTION

1. Field of the Invention

This invention relates to a sliver weight unevenness correcting apparatus, and more particularly, to an apparatus for accurately correcting silver weight unevenness, i.e. short in wavelength, suitable for use in recent high-speed spinning machines such as a drawing frame, a card and a comber.

2. Description of the Prior Art

In a drawing frame, a plurality of slivers fed from respective cans, which have been produced by carding machines in a previous process, are bundled and drafted together to eliminate the individuality of each sliver and to promote paralleling of the fibers. A drawing frame is known in the art, in which during the drafting operation, the draft of a draft device (hereinafter called a main draft device) of the drawing frame body is varied in response to the variations in weight per unit length of the slivers, thereby to correct the sliver weight unevenness. However, the conventional drawing frame is still disadvantageous in the following points: Since the slivers are run at high speed, correction of sliver weight unevenness by controlling the speed of the main draft device requires considerably high technique. In addition, the provision of the sliver weight unevenness correcting apparatus in the drawing frame body makes the construction intricate with the result that the size is necessarily increased.

In view of the difficulty accompanying the method in which the sliver weight unevenness is corrected in the drawing frame body, a method is known in the art, in which a sliver weight unevenness correcting apparatus is provided between the creel device and the drawing frame body with a main draft device in order to correct the weight unevenness before the slivers are introduced into the drawing frame body. However, the conventional method belongs to a so-called "feed-back system". Accordingly, the method reveals serious difficulties when employed for a recent high-speed drawing frame. In the feed-back system, the weight of slivers is measured after the slivers have passed through a correcting draft device, and therefore, time delay occurs before the unevenness correction is actually effected in the device after the weight measurement. Thus, in the system control according to the detected sliver weight (sliver weight unevenness correction) is made for the upstream slivers whose conditions are unknown. Therefore, the system suffers from the essential problem that it is impossible to perform the sliver weight unevenness correction with high accuracy. In the system, it is difficult to correct weight unevenness short in wavelength. The difficulty is further increased as the running speed of the slivers is increased. The above-described time delay is unavoidable because it is the sum of a signal transmission delay and a mechanical transmission delay. In the main draft device, the slivers are drafted four to nine times, and therefore the unevenness short in wavelength which has not been corrected will be increased four to nine times in length. Thus, the correction of the unevenness short in wavelength is the essential factor to determine the quality of produced slivers.

Mechanical means for measuring the sliver weight is generally of a type in which a bundle of slivers are collected and pressed to eliminate the air contained therein, whereby the total thickness of the pressed slivers is taken as the displacement of the depressing roller. Namely, in this case, the weight is substituted by the thickness. In this connection, in the feed-back system, the width of the bundle of slivers is increased to a predetermined value prior to passing through a sliver weight unevenness correcting draft device comprising variable speed draft rollers, so as to effect suitable drafting of the slivers, and then such slivers are to be collected or condensed for measuring in the sliver weight measuring section. Accordingly, the distance between the correcting draft device and the measuring section must be sufficiently long in order to effectively collect the slivers. If the sliver running speed is increased, then it is necessary to increase the distance, which further increases the deviation of unevenness detection. This makes it more difficult to correct the weight unevenness short in wavelength.

Furthermore, when the bundle of slivers passed through the measuring section is introduced into the main draft device, it is necessary to expand the collected slivers so that they are suitable for the main draft operation. Therefore, the distance between the sliver weight measuring section and the main draft device must also be considerably long. In other words, in order that the slivers may be greatly drafted in the main draft device, the slivers should be arranged in parallel with a suitable width and the long distance is required for smoothly and regularly paralleling the bundle of slivers again which have once been collected. The distance is further increased as the sliver running speed is increased.

Thus, with the conventional device, it is necessary to provide a considerably long distance between the sliver weight unevenness correcting device and the main draft device, which results in the formation of a useless wide space. Another disadvantage is that it is impossible to correct the sliver weight unevenness short in wavelength.

Moreover, since a plurality of slivers are fed by feeding rollers of the creel device rotating at a constant speed, the tension of the slivers is always varied between the feeding rollers and the back rollers of the correcting draft device rotating at a variable speed, which results in irregular drafting.

There is still another difficulty in the correcting draft device when it is driven by an independent motor. Namely, in case the back rollers of the correcting draft device are connected to a variable speed rotation transmission mechanism driven by an independent motor to vary the speed of back rollers (relative to that of front rollers) through the transmission mechanism based on the instruction from the weight measurement section, the slivers are liable to be subjected to troubles during the starting, interrupting and inching operations of the apparatus. In this case, the instruction for varying the speed of back rollers is determined relative to the speed of the front rollers and then transmitted to the back rollers. In other words, the back rollers are rotated following the rotation of the front rollers. However, in the starting, interrupting and inching operations, the number of revolutions of the front rollers (i.e. the drawing frame body) is varied rapidly as compared with the response of the back rollers to the speed change instruction given thereto. As a result, during the starting operation, the back rollers may fail to sufficiently follow the front rollers so that the drafting ratio becomes so excessive as to sever the slivers. During the interrupting operation, the slivers are liable to be slackened between the front and back rollers thereby to make it difficult to effect the normal sliver forwarding operation. In addition, the inertial difference in the driving system of the front and back rollers exerts an influence to cause adverse affects upon the aforementioned slivers.

With respect to carding machines, a method is known in the art in which produced slivers are introduced from the doffer to the correcting draft device and to the sliver weight measuring section to correct the sliver weight uneveness. In this case also, if the weight unevenness correcting apparatus according to the feedback system is employed for slivers which run at high speed, then the same troubles are caused, and particularly, it is extremely difficult to correct the unevenness short in wavelength. Other troubles will also occur as in a conventional drawing frame.

SUMMARY OF THE INVENTION

It is therefore an object of the present invention to provide a sliver weight unevenness correcting apparatus of a feed-forward type suitable for use in a high-speed spinnning machine such as a drawing frame, a card or a comber, in which the sliver weight unevenness, even short in wavelength, can be corrected with high accuracy.

It is another object of the present invention to provide the above-mentioned apparatus in which time delay from the sliver weight-measurement to the correction operation is prevented by positioning a correcting draft device downstream of the sliver weight measuring section.

It is still another object of the present invention to provide the above-mentioned apparatus in which the space required for the apparatus is much less as compared with conventional ones.

It is still another object of the present invention to provide the above-mentioned apparatus having a delay circuit for delaying the correcting operation until the slivers to be corrected reach the correcting draft device, thereby increasing the accuracy of the correcting operation.

It is still another object of the present invention to provide the above-mentioned apparatus in which the number of revolutions of the back rollers of the correcting draft device is controlled based on the difference between the target and actual number of revolutions of the back rollers, thereby correcting the sliver weight unevenness with high speed and high precision.

It is a further object of the present invention to provide the above-mentioned apparatus in which the variation in tension of the slivers between the feeding rollers of the creel device and the back rollers of the correcting draft device is prevented.

It is still a further object of the present invention to provide the above-mentioned apparatus in which the difficulties such as breaking and slackening of slivers are prevented during the starting, interrupting and inching operations.

According to the invention, the above objects are achieved by providing a sliver weight unevenness correcting apparatus of a feed-forward type, which comprises: a sliver weight measuring section having a sliver weight detecting sensor for detecting the variations in weight of a bundle of slivers; a correcting draft device having front rollers disposed downstream of the sliver weight measuring section relative to the direction of advancement of slivers, the front rollers being rotated at a constant speed, and back rollers disposed between the sliver weight measuring section and the front rollers, the back rollers being rotated at a variable speed; rotation detecting means for detecting the number ($N_F$) of revolutions of the front rollers; an unevenness correcting circuit comprising a ratio circuit for operating a ratio ($E_0/E_1$) between a reference weight (Eo) of the bundle of slivers and the detected weight ($E_1$) thereof; a contrasting operational circuit for multiplying the operational ratio ($E_0/E_1$) from the ratio circuit and a ratio ($N_F/k$) between the number ($N_F$) of revolutions of the front rollers from the rotation detecting means and a reference draft value (k) and for producing a multiplied signal ($E_0/E_1 \cdot N_F/k$); and a speed control circuit for producing a speed control signal responsive to the multiplied signal ($E_0/E_1 \cdot N_F/k$) from the contrasting operational circuit, so that the signals of the speed control circuit are outputted to control the speed of rotation of the back rollers through a rotation transmitting mechanism.

According to this feed-forward system, the sliver weight unevenness is corrected by the correcting draft device which is positioned downstream of the sliver weight measuring section in view of the advancing direction of the slivers. This arrangement prevents the time delay from the weight measurement of the actual correcting operation so that it is highly advantageous for the correction of the sliver weight unevenness short in wavelength and in a high-speed spinning machine. Since, moreover, the correcting draft device effects the correcting operation with the bundled slivers under their parallel condition immediately upstream of the main drafting device, the latter device can receive the regularly arranged slivers as they are, so that the original great and uniform draft operation is not affected at all, and slivers high in quality can be produced. Further, this system prevents the formation of a useless space between the sliver weight unevenness correcting apparatus and the main draft device.

In addition, the invention is advantageous in that the front rollers of the correcting draft device can be substituted by the rollers of the main draft device.

A sliver weight unevenness correcting apparatus according to the present invention is equally applicable to a drawing frame, a card, a comber or the like.

According to a first aspect of the invention, a delay circuit is added to the above-mentioned sliver weight unevenness correcting apparatus. More particularly, the sliver weight unevenness correcting apparatus further comprises a delay circuit for delaying the speed control of the back rollers (to be effected in response to a signal from the contrasting operational circuit) for a predetermined period of time.

With this construction, the draft correcting operation is delayed for a predetermined period of time until the slivers having passed through the sliver weight measuring section reach the correcting draft device downstream thereof, thereby effecting the sliver weight unevenness correction with high precision.

Three typical examples according to the first aspect of the invention will be described.

In the first example, the delay time is set constant by taking into account the distance between the sliver weight measuring section and the correcting draft device as well as the sliver running speed in the correcting draft device. This is sufficiently applicable to the case where the speed of slivers in the correcting draft device is not greatly changed.

The second and third examples are different from the first one in that the delay time is varied with the speed of slivers in the correcting draft device.

In the second example, the delay circuit functions to set the delay time according to the speed (circumferential speed) of the front rollers in the correcting draft device. In general, the front rollers are driven to rotate at a constant speed. However, sometimes it is necessary to vary the speed of the front rollers in accordance with the requirements of the main draft device to change the spinning speed depending on the kind, condition and production amount of slivers, or for some other reasons. In such a case, the second example is advantageous in that, as the time delay is automatically varied with variation in speed of the front rollers, the trouble of changing the speed of the front rollers whenever required is eliminated.

In the third example, the delay circuit functions to set the delay time according to the speed (circumferential speed) of the back rollers in the correcting draft device. As the speed of the back rollers is varied according to the sliver weight detected by the sliver weight measuring section, the time which elapses from the time that the slivers leave the sliver weight measuring section until they reach the correcting draft device is changed. The delay time is controlled in correspondence to the time thus changed. Thus, in the third example, the draft ratio is controlled at the time instant when the slivers whose weight has been detected by the sliver weight measuring section reach the correcting draft device. Therefore, the sliver weight unevenness correction in the third example is effected with higher accuracy than that in the first or second one. Thus, the third example is an ideal one and is the preferred form of the invention.

The first aspect of the invention can be applied to a drawing frame as follows:

The sliver weight unevenness correcting apparatus comprises, in the direction of advancement of the slivers from a creel device 1 towards a main draft device 15: a collector 4 for collecting a plurality of slivers; a sliver weight measuring section 8 having a grooved roller 6 with a groove adapted to surround the collected slivers, and a pressing roller 7 which is fitted into the groove and is displaced according to the variations in weight of the bundle of slivers; a sensor 31 for detecting displacement of the pressing roller 7 (see FIG. 3); an expanding device 9 for increasing the width of the bundle of slivers having passed through the measuring section 8; a correcting draft device 12 having back rollers 10 whose speed is varied in response to the signal from an unevenness correcting circuit, and front rollers 11 to which constant rotation is transmitted from the main draft device 15; a rotation sensor FS for detecting the number of revolutions of the front rollers 11 (see FIG. 8); an unevenness correcting circuit comprising a ratio circuit and a contrasting operation circuit for operating $E_0/E_1 \cdot N_F/k$, where $E_1$ represents a value representative of the sliver weight detected by the sensor 31; $E_0$ represents a reference weight; $N_F$ represents the number of revolutions of the front rollers detected by the rotation sensor $F_S$; k represents a reference draft value (the same hereinafter); a delay circuit DC for delaying the speed control of the back rollers for a predetermined period of time; and a speed control circuit for producing a speed control signal responsive to the signal from the unevenness correcting circuit OC, so that the speed control of the back rollers is effected with the predetermined delay time through a rotation transmitting mechanism.

With this construction, the slivers are subjected to draft correction with a delay corresponding to the time which elapses from the time instant that the silver weight is measured until the slivers reach the correcting draft device. Therefore, the sliver weight unevenness correction can be carried out with high accuracy.

This example is advantageous in that, even if slivers run at high speed as in recent high-speed drawing frames, the trouble due to the time delay from the measurement to the actual correction, which accompanies a conventional device, is prevented, and the unevenness short in wavelength can be corrected accurately. Furthermore, the correcting draft device subjects a bundle of slivers in parallel state to correction draft immediately before the body draft device, and therefore the slivers can be delivered, as they are, to the main draft. Accordingly, the original great draft operation is not affected at all, and slivers high in quality can be produced.

In this example, the front rollers of the correcting draft device may be substituted by the rollers of the main draft device.

The sliver weight unevenness correcting apparatus according to the second aspect of the invention is different from the first-mentioned apparatus (having no delay circuit) in that the apparatus further comprises: a second rotation sensor for detecting the number ($N_B$) of revolutions of the back rollers; and a comparison circuit connected to the second rotation sensor for detecting the difference between a signal $(E_0/E_1)\times(N_F/k)$ outputted by the contrasting operational circuit and a signal ($N_B$) representative of the number of revolutions of the back rollers outputted by the second rotation sensor to output a signal corresponding to the difference, so that the speed control circuit produces a speed control signal to a rotation transmitting mechanism to the back rollers according to the signal from the comparison circuit.

The apparatus thus organized is meritorious in that the difference between the target number of revolutions of the back rollers and the actual number of revolutions thereof is obtained and the speed of the back rollers is controlled according to the difference thus obtained, whereby the sliver weight unevenness can be corrected at high speed and with high accuracy.

According to one example of the second aspect of the invention, the apparatus further comprises a delay circuit, so that the speed of the back rollers is controlled with a predetermined delay time after the application of the signal. In this case, the correction is effected only when the slivers whose weight has been measured by the sliver weight measuring section reach the correcting draft device disposed downstream thereof. Accordingly, the device according to the invention has merit in that the sliver weight unevenness can be corrected with high accuracy.

According to another example of the second aspect of the invention, the comparison circuit comprises: a subtraction circuit for detecting the difference between the signal $(E_0/E_1)\times(N_F/k)$ outputted by the contrasting operational circuit and the signal ($N_B$) representative of the number of revolutions of the back rollers outputted by the second rotation sensor; and an integration circuit for integrating a difference signal outputted by the subtraction circuit and outputting an integration signal. In this case, the amount of control in draft correction is changed according to the difference between the target number of revolutions $(E_0/E_1)\times(N_F/k)$ of the back rollers and the actual number of revolutions $N_B$ of the back rollers. Therefore, in this case, the control can be effected with high response and high accuracy.

The second aspect of the invention can be applied to a drawing frame as follows. The sliver weigh unevenness correcting apparatus comprises, as in the case according to the first aspect of the invention: a collector; a sliver weight measuring section 8 having rollers 6 and 7; a sensor 31; an expanding device 9; a correcting draft device 12 having rollers 10 and 11; a first rotation sensor $F_S$ for detecting the number of revolutions of the front rollers; a second rotation sensor $B_S$ for detecting the number of revolutions of the back rollers; an unevenness correcting circuit comprising a ratio circuit and a contrasting operational circuit for operating $(E_0/E_1)\times(N_F/k)$ by using a signal $E_1$ representative of the sliver weight detected by the sensor and a signal $N_F$ representative of the number of revolutions of the front rollers detected by the first rotation sensor, and a comparison circuit for detecting the difference between a signal $(E_0/E_1)\times(N_F/k)$ outputted by the contrasting operational circuit and a signal $(N_B)$ representative of the number of revolutions of the back rollers outputted by the second rotation sensor; and a speed control circuit for outputting a speed control signal to the rotation transmitting mechanism of the back rollers according to a signal outputted by the comparison circuit.

The apparatus thus constructed has merit in that the difference between the target number of revolutions of the back rollers and the actual number of revolutions thereof is obtained and the speed of the back rollers is controlled according to the difference thus obtained, whereby the sliver weight unevenness in the drawing frame can be corrected at high rate and with high accuracy.

Furthermore, the apparatus has merits similar to one according to the first aspect of the invention as follows: even if the slivers are run at high speed, the time delay from the measurement to the correction can be eliminated, as a result of which the unevenness short in wavelength can be corrected with high accuracy. Since the correcting draft device drafts the paralleled slivers immediately before the main draft device and thus the slivers are introduced to the device as they are, the original great drafting operation is not affected at all, and slivers having fine quality can be produced. The front rollers of the correcting draft device can be employed commonly as the rollers of the main draft device.

According to the third aspect of the invention, the sliver weight measuring section of the apparatus comprises a grooved roller with a groove adapted to surround slivers and a pressing roller which is fitted into the groove of the grooved roller and is displaced in accordance with the variations in weight of the bundle of slivers, so that the back rollers of the correcting draft device are connected in a drive transmitting relationship with the rotation transmitting mechanism and are further connected in a drive transmitting relationship with the grooved roller and feeding rollers of the creel device. With this construction, variable speed rotation in the correcting draft device is transmitted to the sliver weight measuring section and to the feeding rollers of the creel device, whereby the slivers are fed from the creel device in synchronism with the variable speed of the correcting draft device.

Thus, in addition to merits common to various aspects of the invention this apparatus has the merit that irregular drafting due to the variation in tension of slivers between the creel device and the correcting draft device is prevented.

According to the fourth aspect of the invention, the apparatus is so constructed as to eliminate the adverse effects on the slivers when the rotations are abruptly varied in a case where at least the back rollers of the correcting draft device are driven by an independent motor through a variable speed rotation transmitting mechanism. More specifically, with a view to interrupting the correcting operation during a preset time period for the starting and interrupting operations, and during the inching operation, clutch means connected to the main draft device is incorporated into a variable speed rotation transmitting mechanism of the back rollers. As a result, a constant speed rotation is transmitted from the main draft device directly to the back rollers during a preset time period for the starting and interrupting, and during the inching operation, thereby preventing breaking and slackening of the slivers during these operations.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts throughout the several views, and wherein:

FIGS. 1 through 6 are common to the first through fourth embodiments of the invention, wherein:

FIG. 1 is a plan view showing the entire arrangement of a sliver weight unevenness correcting apparatus, which is employed for a drawing frame;

FIG. 2 is a perspective view showing the essential components of the apparatus;

FIG. 3 is a perspective view showing the drive mechanism in a sliver weight measuring section;

FIG. 4 is a sectional front view showing a bundle of slivers which are compressed between a grooved roller and a pressing roller;

FIG. 5 is a block diagram showing a sliver weight unevenness correcting circuit according to the first embodiment of the invention; and FIG. 6 is a block diagram showing a delay circuit in the sliver weight unevenness correcting circuit in FIG. 5;

FIGS. 14 through 17 show the fifth embodiment of the invention, wherein:

FIG. 14 is a top plan view of the entire arrangement of the apparatus including the clutch means according to this embodiment;

FIG. 15 is a perspective view showing an essential portion thereof;

FIG. 16 is an electric circuit diagram showing the operating conditions of an electromagnetic clutch during the starting, interrupting and inching operations; and FIG. 17 is a top plan view of another example to which the clutch means is applied.

DETAILED DESCRIPTION OF THE PREFERRED EMBODIMENTS

Figure 1:
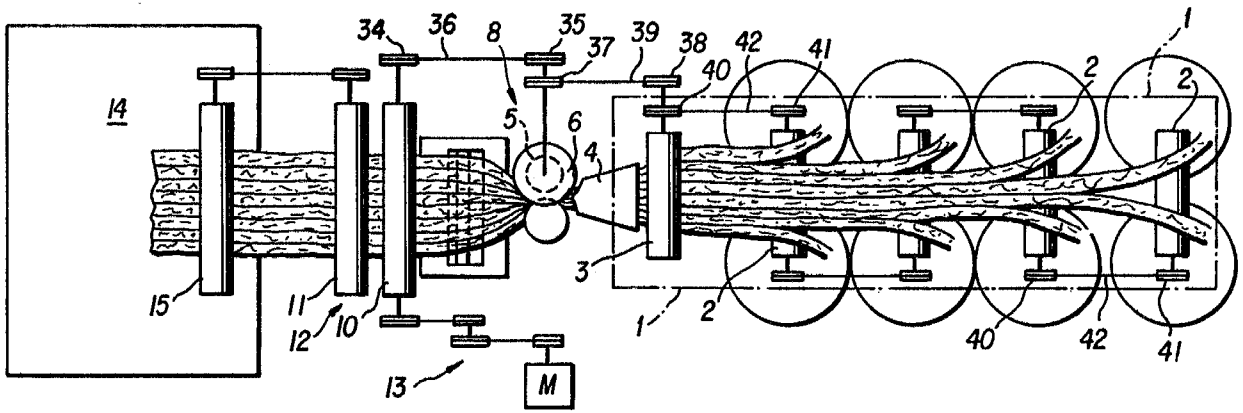

The invention will be described with reference to its embodiments shown in the accompanying drawings, wherein like reference numerals indicate like parts throughout the several views.

A sliver weight unevenness correcting apparatus according to the first embodiment (which belongs to the second example of the first aspect of the invention) applied to a drawing frame will be described with reference to FIGS. 1 to 7.

Figure 2:
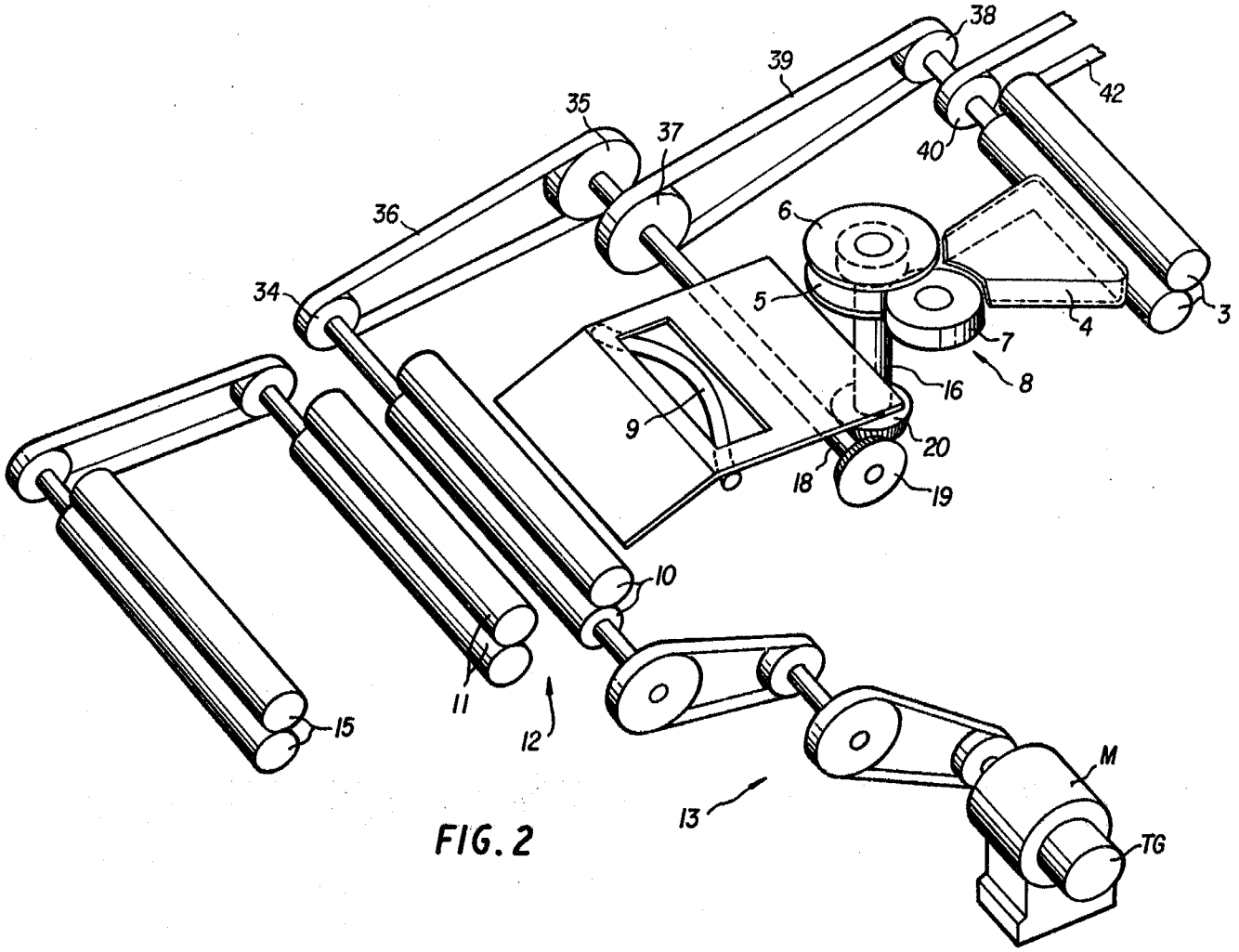

FIGS. 1 and 2 show the outline of the apparatus, wherein eight slivers fed from the respective cans are laid over feeding rollers 2 provided on a creel device 1 and are successively arranged in parallel with one another. The eight slivers thus arranged are introduced to a collector 4 through a pair of guide rollers 3 provided at the front part of the creel device 1. Provided at the outlet of the collector 4 is a sliver weight measuring section 8 which comprises: a grooved roller 6 with a groove 5 adapted to surround a bundle of collected slivers; and a pressing roller 7 which is fitted into the groove 5. The roller 7 is displaced in response to variations in weight of the sliver bundle. Therefore, the weight variation is measured as an amount of displacement of the pressing roller 7. That is, the weight per unit length of the sliver bundle is converted into the thickness of the sliver bundle from which the air has been removed, so that the weight variation is measured as a variation in thickness. Provided adjacent to the sliver weight measuring section 8 is an expanding device 9 in convexed form which is adapted to expand and arrange the bundle of collected slivers in parallel with one another again, so that the bundle of slivers is suitable for drafting. The slivers arranged in parallel while passing over the expanding device are introduced to a correcting draft device 12 which comprises two pairs of draft rollers 10 and 11, for correcting sliver unevenness. The back rollers 10 are given, through a transmission mechanism 13, a variable speed rotation transmitted by a variable speed motor M to which the displacement of the pressing roller 7 is transmitted as an electrical signal. The front rollers 11 are given a rotation by back rollers of a main draft device 15 of a drawing frame body 14. The slivers, after being subjected to weight unevenness correction by the correcting draft device 12, are delivered to the main draft device 15, where they are greatly drafted into produced slivers.

Figure 4:
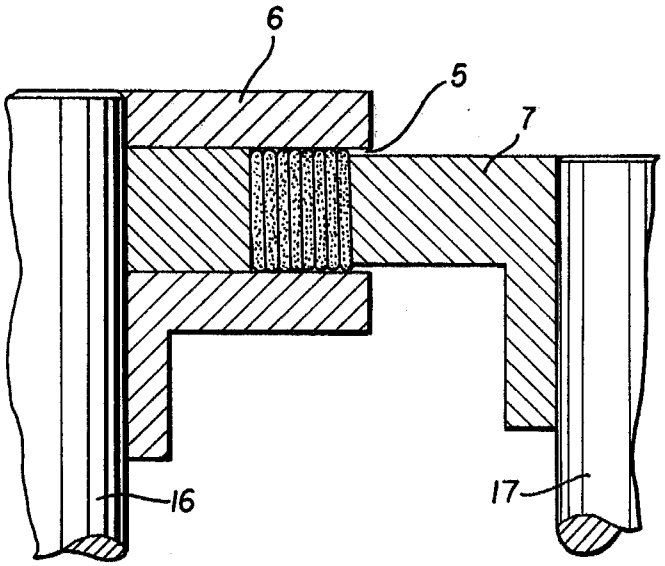
Figure 3:
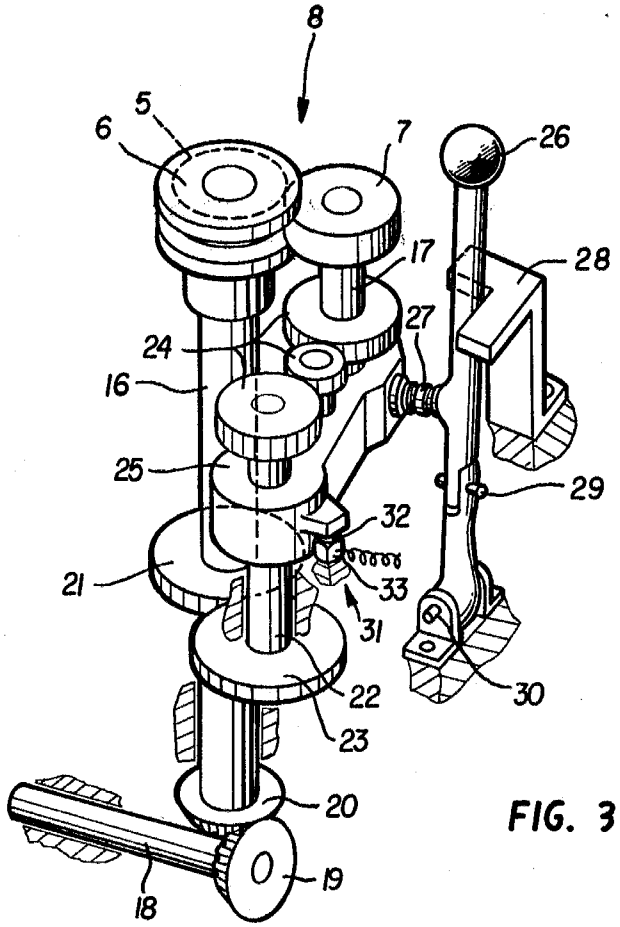

The arrangement of the sliver weight measuring section 8 in the sliver weight unevenness correcting apparatus thus constructed will be described in more detail with reference to FIG. 3. The grooved roller 6 and the pressing roller 7 are mounted on rotary shafts 16 and 17, respectively, whose axes are perpendicular to the longitudinal axes of the rollers 10 and 11 of the correcting draft device 12 and the other rollers; that is, the rollers 6 and 7 are laterally coupled to each other, which contributes greatly to the measurement of the weight of a bundle of slivers. The width of the bundle of slivers which are juxtaposed is decreased by the collector 4, and the slivers are pressed with the positional relationships thereof being maintained unchanged and are fed into the groove 5 of the grooved roller 6 as they are, as shown in FIG. 4. Therefore, the displacement of the pressing roller 7 corresponds directly to the thickness of the bundle of slivers, i.e., the weight variation thereof. In the conventional device, the rollers 6 and 7 are vertically coupled to each other, and therefore, the bundle of slivers is depressed in a direction different from the direction in which the width is decreased by the collector 4, as a result of which the positional relationships of the slivers is liable to become irregular, and sometimes a sliver or slivers may run obliquely. Thus, sometimes it is impossible to correctly measure the weight thereof. The mounting shaft 16 of the grooved roller 6 is rotated by a bevel gear 20 which is engaged with the bevel gear 19 of a shaft 18 which is driven by the back rollers 10 in the correcting draft device 12. On the other hand, the mounting shaft 17 of the pressing roller 7 is rotated, through a train of gears 24, by the gear 23 of a shaft 22, which is engaged with the gear 21 of the shaft 16. The train of gears 24 are provided in association with a support arm 25 which can turn around the shaft 22. The support arm 25 is pushed towards the grooved roller 6 by means of a compression spring 27 which is disposed between the support arm 25 and an engaging handle 26. Before slivers are initially inserted into the groove 5 of the grooved roller 6, it is necessary to disengage the pressing roller 7 from the grooved roller 6. Accordingly, the engaging handle 26 is so designed that it can turn around a shaft 29 so as to be disengaged from a locking bracket 28. Furthermore, the engaging handle 26 can be turned around a shaft 30 to change the length of the spring 27. When the engaging handle 26 is engaged with the locking bracket 28, the slivers in the groove 5 are compressed by the pressing roller 7, so that the pressing roller 7 and the support arm 25 are swung around the shaft 22. Therefore, a sensor 31 for measuring the weight of a bundle of slivers can be disposed in association with the swinging section. More specifically, the sensor 31 is made up of a magnetic element 32 provided on a protrusion which is formed in the vicinity of the base of the support arm 25, and a magnetoelectric conversion element 33 provided at a stationary position slightly spaced from the magnetic element 32. In this case, the magnetic element 32 is confronted with the magnetoelectric conversion element 33 in a direction perpendicular to the plane in which the support arm 25 is swung. Therefore, when the support arm 25 is swung in accordance with the variation in the sliver weight, the distance between the two elements can be maintained unchanged; however, the coincident area of the confronted surfaces thereof is varied. The value of the coincident area can be converted into a magnetoelectric conversion value corresponding to the weight of slivers under measurement. The output of the magnetoelectric conversion element 33 corresponding to the position of the pressing roller 7 which is based on the average weight of slivers is employed as a set value. An electrical signal proportional to the deviation of a detection value according to the displacement of the pressing roller 7 from the set value is applied to the variable speed motor M, to change the speed of the back rollers 10 of the correcting draft device 12 to correct the weight unevenness. As a result, the slivers having a uniform weight can be fed to the main draft device 15 of the drawing frame body 14.

Figure 5:
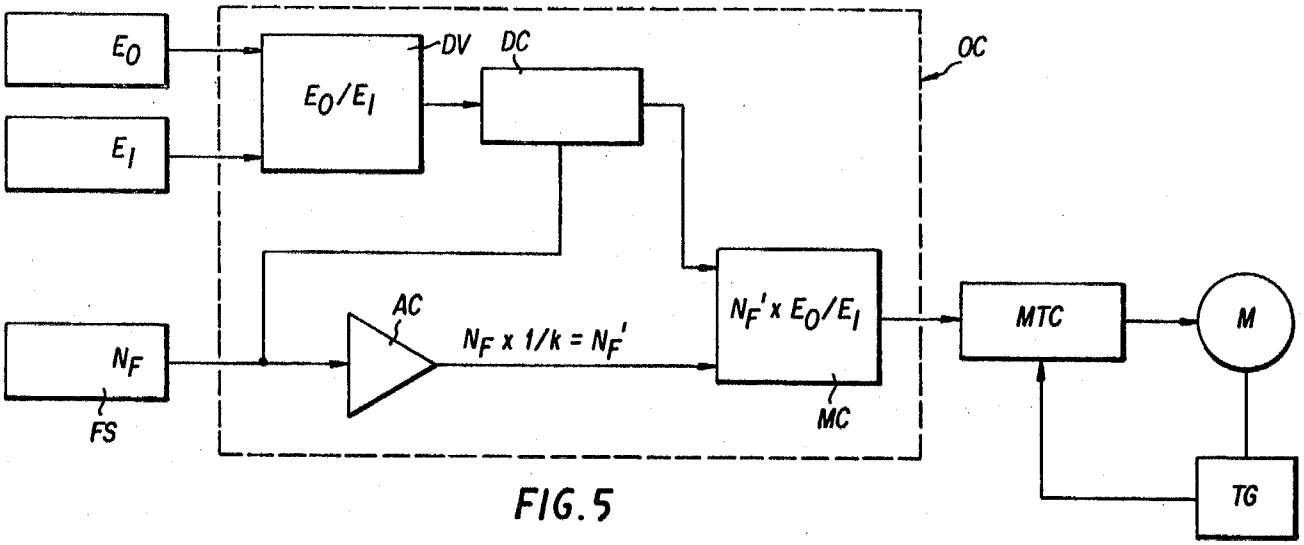

The unevenness correcting principle of an unevenness correcting circuit shown in FIG. 5 and the above-described correcting draft device is described below. The circuit and device are to correct the unevenness in order to make uniform the thickness of slivers to be delivered to the main draft device of the drawing frame body.

The correction is carried out by suitably controlling the circumferential speed ratio (surface speed ratio, draft value) between the front rollers 11 and the back rollers 10. For instance, in the case of a correction of ±30%, the reference draft k is set to 1.3. When the thickness of slivers is larger than the reference value, then the draft value is set to more than 1.3; and when it is smaller, then the draft value is set to less than 1.3. For this purpose, the unevenness correcting circuit OC comprises: a divider DV; an amplifier AC; a multiplier MC; and a delay circuit for delaying the signal for a period of time corresponding to the revolutions per minute of the front rollers 11, the circuit OC being connected to a speed control circuit constituted by a motor controller. The divider DV operates to subject the output of the sensor 31, i.e., a detection value $E_1$ based on the weight of slivers which have passed and a preset value $E_0$ corresponding to the reference weight of slivers, to comparison ($E_0/E_1$). An electrical signal according to the value ($E_0/E_1$) is applied to the variable speed motor M to change the speed of the back rollers 10. In this case, the value of the electrical signal is determined in comparison with the revolutions per minute (or the circumferential speed) of the front rollers 11 which rotate at a higher speed than the back rollers 10 with the preset reference draft value. That is, in the multiplier MC, a value ($N_F'(=N_B)=N_F\times 1$/reference draft value (=k)) obtained by multiplying the revolutions per minute $N_F$ of the front rollers 11 by the inverse number of the reference draft value, is multiplied by the aforementioned value ($E_0/E_1$). As a result, the unevenness correcting circuit outputs a control signal $E_0/E_1 \cdot N_F/k$.

In actually operating the correcting draft device 12 by an electrical signal according to the control signal outputted by the operational circuit, the delay circuit DC is employed to delay the operation of the correcting draft device until the time instant when the slivers to be measured reach the back rollers 10. In this embodiment, the delay is effected after the calculation $E_0/E_1$ of the detection value $E_1$ and the set value $E_0$, and the delay time is set in association with the revolutions per minute of the front rollers 11. The delay time is set by taking into account the distance between the measuring section 8 and the back rollers 10, as well as signal transmission delay and mechanical transmission delay. The electrical signal based on the value which is calculated with a delay time is applied to the motor controller MTC serving as the speed control circuit and to the variable speed motor M. The rotation of the motor M is transmitted through the rotation transmitting mechanism 13 to the back rollers 10 to correct the sliver weight unevenness.

The above-described delay circuit DC will be further described with reference to FIG. 6. The delay circuit DC is made up of a first level adjusting circuit $LC_1$, a clock pulse generating circuit CP, a delay element DE and a second level adjusting circuit $LC_2$.

The first level adjusting circuit $LC_1$ is connected to the divider DV which subjects the detected sliver weight $E_1$ and the reference sliver weight $E_0$ to division ($E_0/E_1$). The first level adjusting circuit $LC_1$ adjusts the level of the output signal ($E_0/E_1$) of the divider DV, i.e., the signal amplitude and the zero point, so as to meet the input signal conditions of the delay element DE connected thereto. In other words, in the first level adjusting circuit $LC_1$, when the input signal is larger, then it is attenuated; and when the input signal is smaller, then it is amplified, so that the input signal has a suitable level.

The clock pulse generating circuit CP comprises a V-f converter and is connected to the rotation sensor of the front rollers 11, so as to output a clock pulse signal having a period TC corresponding to the revolutions per minute $N_F$ of the front rollers 11. The period of the clock pulse signal is set to a value with which a desired delay time is provided by the delay element DE connected to the circuit CP.

Figure 7:
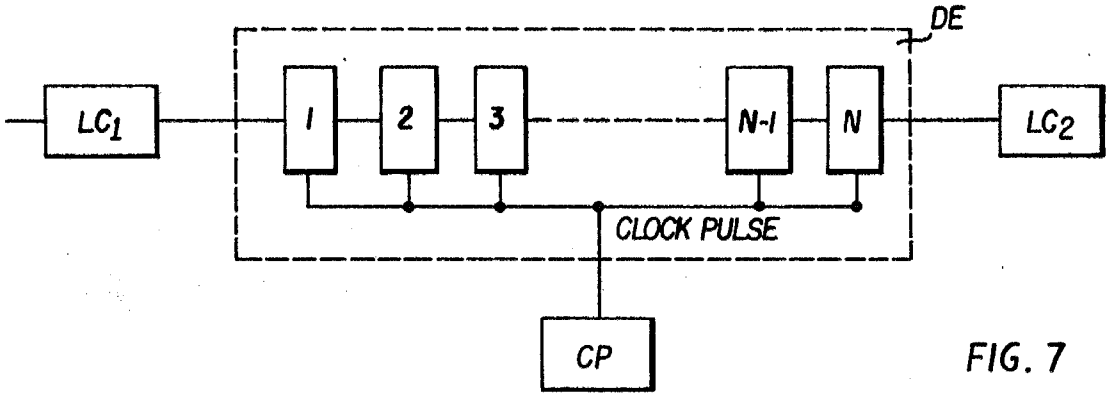
FIG. 7 is a block diagram showing delay elements in the delay circuit in FIG. 6.

The delay element DE, as shown in FIG. 7, comprises N delay element units. In the delay element DE, the output signal of the first level adjusting circuit $LC_1$ is shifted from one delay element unit to another whenever the clock pulse signal from the clock pulse generating circuit CP is applied to the delay element DE. Since the number of delay element units is N, the delay time $T_D$ which elapses from the time instant that the input signal is applied until the output signal is provided can be represented by the product $N\times T_C$ of the number N of delay element units and the period $T_C$ of the clock pulse signal. Accordingly, in this embodiment, the delay time according to the revolutions per minute $N_F$ of the front rollers 11 is determined by controlling the period $T_C$ of the clock pulse signal in accordance with the revolutions per minute of the front rollers 11. The second level adjusting circuit $LC_2$ is connected to the delay element DE. The circuit $LC_2$ restores to original signal level the signal level which has been adjusted by the first level adjusting circuit $LC_1$ so as to match it with the input level of the delay element DE. Accordingly, the output signal of the second level adjusting circuit $LC_2$ is equal in level to the output signal of the above-described divider DV; however, the former signal is delayed as much as the delay time from the latter signal.

The value of the electrical signal applied to the motor M is determined by operating the ratio ($E_0/E_1$) of the set value $E_0$ to the detection value $E_1$ of the sensor 31 and the revolutions per minute of the front rollers 11. Therefore, even if the spinning conditions are changed to change the speed of the main draft device 15, the speed of the front rollers 11 driven by the main draft device 15 is also changed, whereby the reference revolutions per minute of the back rollers 10 is automatically changed. This is considerably advantageous.

Furthermore, the delay circuit is arranged in association with the speed of the front rollers 11. Therefore, when the speed of the main draft device 15 is changed, the delay time is automatically changed, in such a manner that it is decreased when the speed is increased, and it is increased when the speed is decreased. Thus, as the speed of the main draft device 15 is changed, the delay time is automatically changed by the delay circuit. Therefore, when the slivers having passed through the sliver weight measuring section reach the correcting draft device, they are subjected to draft correction, with the result that the sliver unevenness correction is obtained with high accuracy.

The variable speed motor M receives through the speed control circuit the electrical signal, or the speed control signal, based on the calculated value ($E_0/E_1$)×$N_F$×(1/reference draft value). However, sometimes the motor M may not be able to control its speed as instructed by the instruction owing to the variation of load, or the like. Therefore, a rotation detector TF is provided for the motor, so that the detection signal of the rotation detector is fed back to the motor controller to permit the motor to change its speed as instructed by the signal.

In the apparatus according to this embodiment, the delay circuit is provided in the unevenness correcting circuit so that the period of time which elapses from the time instant that the sliver weight is measured to detect the unevenness in the measuring section 8 until the speed of the back rollers 10 is changed, coincides with the period of time which elapses until the slivers thus measured reach the back rollers 10. Therefore, with this apparatus, the sliver weight unevenness short in wavelength can be corrected with high accuracy. Even if the provision of the sliver bundle expanding device 9 makes a certain space between the measuring section 8 and the correcting draft device 12, no trouble is caused because the delay time can be set by taking such distance into account. As the slivers are regularly paralleled by being passed through such expanding device 9, they can be correctly subjected to correction draft by the correcting draft device 12.

Furthermore, after the sliver thickness detection value and the set value are subjected to comparison operation, the resultant value and the revolutions per minute of the front rollers 11 driven by the main draft device are subjected to contrasting operation. Accordingly, when the speed of the main draft device is changed, the reference revolutions per minute of the back rollers 10 is automatically changed. This is another advantage of the invention.

Similarly, the delay circuit is associated with the revolutions per minute of the front rollers 11, and therefore the delay time can be automatically changed as the speed of the main draft device 15 is changed. This is still another advantage of the invention. No action is applied to the bundle of slivers which have passed through the correcting draft device 12. That is, the slivers are fed directly to the main draft device 15 while being regularly arranged in parallel with one another. Accordingly, the distance between the two devices 12 and 15 can be extremely short.

The space between the creel device 1 and the measuring section 8 is conventionally large, which provides a sufficient space for collecting a bundle of slivers without increasing the space in the present invention. Thus, the distance between the creel device 1 and the main draft device 15 is short when compared with the case according to the feed-back system; that is, the useless space can be decreased.

In addition, the back rollers of the main draft device 15 may be commonly employed as the front rollers 11.

Figure 8:
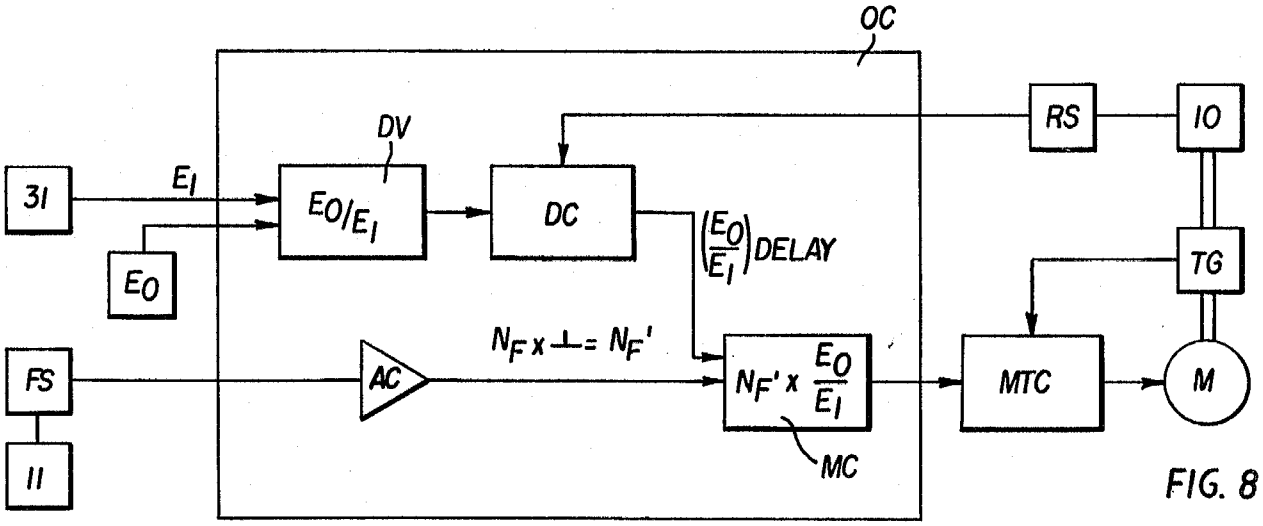
FIG. 8 is a block diagram showing a sliver weight unevenness correcting circuit according to the second embodiment of the invention.

A sliver weight unevenness correcting apparatus according to the second embodiment (which belongs to the third example of the first aspect of the invention) will be described with reference to FIG. 8.

The second embodiment is different from the above-described first embodiment in that the delay time of the delay circuit is controlled according to the revolutions per minute (circumferential speed) of the back rollers. The differences will be mainly described. Those components which have been described with reference to the first embodiment are designated by the same reference numerals and the description thereof will be omitted.

Figure 6:
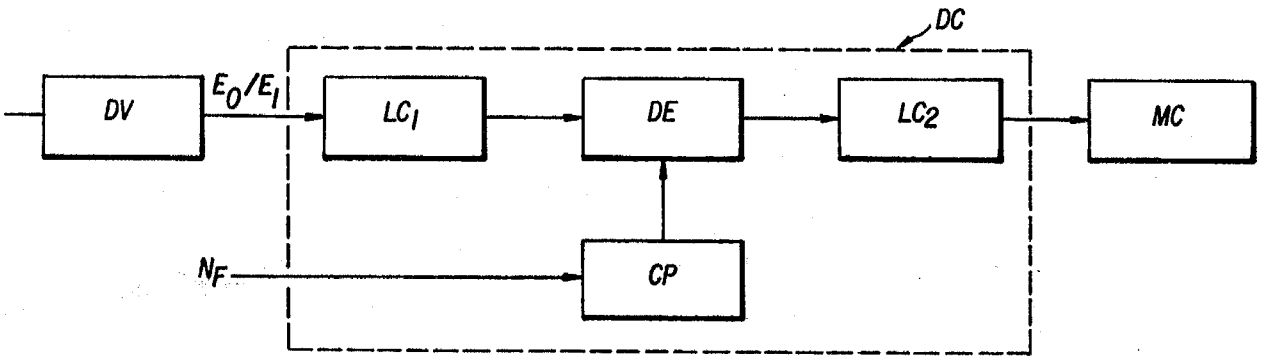

The delay circuit in the unevenness correcting circuit is similar in construction to that in the above-described first embodiment shown in FIGS. 6 and 7. A clock pulse generating circuit CP is connected to a rotation sensor RS which is provided in association with the back rollers 10 which are driven by a motor M. The clock pulse generating circuit CP outputs a clock pulse signal corresponding to the speed of the back rollers 10 in accordance with a signal outputted by the rotation sensor RS, thereby to control the delay time according to the speed of the back rollers 10.

The principle of delay of the correcting draft device in the second embodiment is described below. In the second embodiment, a signal $E_0/E_1$ is delayed until slivers passed through the sliver weight detecting section reach the back rollers 10, thereby to carry out the sliver control most suitably.

The delay time $T_D$ can be represented by $1/N_B$ sec, where the distance between the detecting section and the back rollers is represented by lm, and the speed of the back rollers is represented by $N_B$ m/sec. The delay time $T_D$ is proportional to the period $T_C$ of the clock pulse signal outputted by the clock pulse generating circuit CP, and it is therefore inversely proportional to the frequency $f_C$ (corresponding to the revolutions per minute of the back rollers) of the clock pulse signal.

$$T_D = N \cdot T_C = N \cdot 1/f_C$$

Accordingly, the delay time $T_D$ can be represented as follows, from the relation between the distance l and the speed of the back rollers, and the above equation:

$$T_D = l/N_B = N/f_C$$

Since the distance lm between the detecting section and the back rollers, and the number N of elements in the memory element ME are constants, the above equation can be rewritten as follows:

$$T_D = K_1 \cdot f_C^{-1} = K_2 \cdot N_B^{-1}$$

Accordingly, if the frequency $f_C$ of the clock pulse generating circuit CP is set to be proportional to the speed $N_B$ of the back rollers 10, then the delay time $T_D$ can be varied with the speed $N_B$ of the back rollers 10 even if the speed of the back rollers 10 is varied.

In the above-described second embodiment, because of the conditions required for the correcting draft device, even if the speed of the back rollers 10 is changed, the delay time is controlled in correspondence to the change. Therefore, at the time instant when the slivers subjected to weight detection by the sliver weight detecting section reach the back rollers 10 in the correcting draft device, the draft correction is carried out. Thus, the second embodiment has a merit that the draft correction can be carried out with extremely high accuracy and uniform slivers can be introduced to the body draft device. The second embodiment provides an ideal apparatus for delaying the draft correction control, which is most suitable for the case where high precision draft correction is required.

Figure 9:
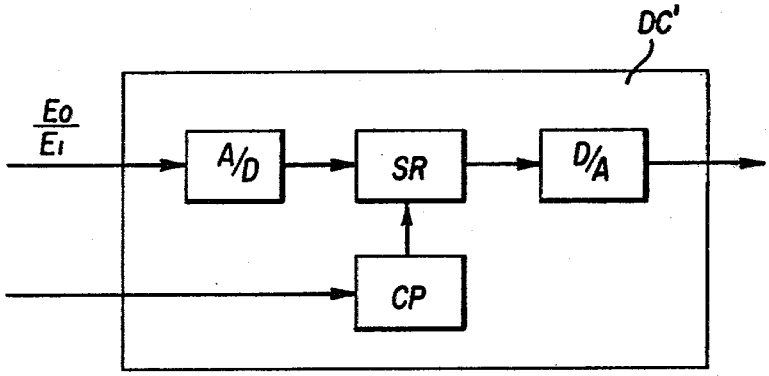
FIGS. 9 and 10A and 10B are diagrams showing other examples of the delay circuit.
Figure 10A:
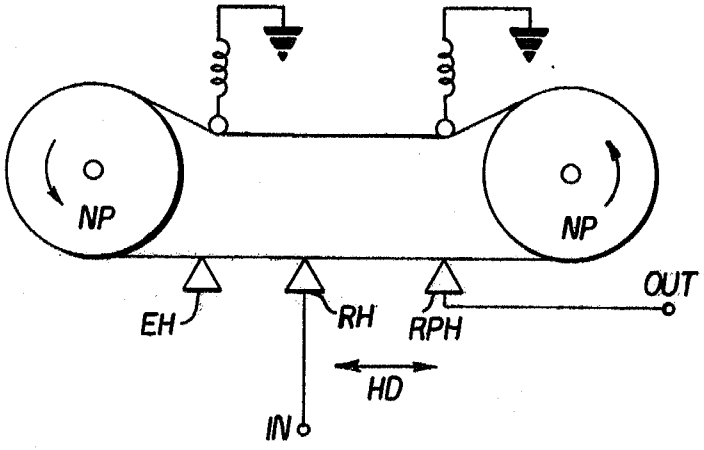
Figure 10B:
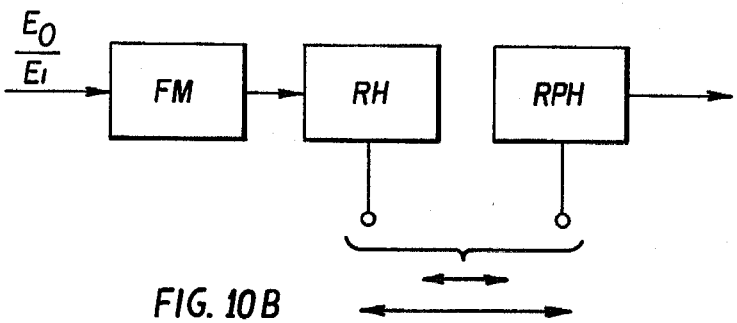

In the above embodiments, a typical delay circuit in the unevenness correcting circuit has been described. However, the invention may be modified as shown in FIGS. 9 or 10A and 10B, or may be modified in other ways with the same effects. In the modified delay circuit DC' shown in FIG. 9, when the signal $E_0/E_1$ is detected as an analog signal, the latter is converted into a digital signal by the A-D converter. The digital signal is applied to a shift register SR which is controlled by the output clock pulse of a clock pulse generating circuit CP, and the digital signal is converted into an analog signal by a D-A converter connected to the shift register SR.

This modification is advantageous in that, as the analog signal is delayed after being converted into the digital signal, the circuit is not affected by temperature or the like and is stable, as a result of which the stable draft correction can be carried out.

In the modification shown in FIGS. 10A and 10B, a tape recorder is employed in which an endless magnetic tape is laid. In this case, the signal $E_0/E_1$ is converted into an FM signal, which is applied to the recording head of the tape recorder. According to the speed of the front rollers or the back rollers, the distance HD between the recording head RH and the reproducing head RPH is changed with the tape running speed constant (FIG. 10A, in which EH shows an erasing head) or the tape running speed NP is changed with the distance between the heads constant (FIG. 10B), thereby to control the time of application of the FM signal to the reproducing head, i.e., the delay time. Alternatively, analog delay elements CCD and BBD may be employed.

Figure 11:
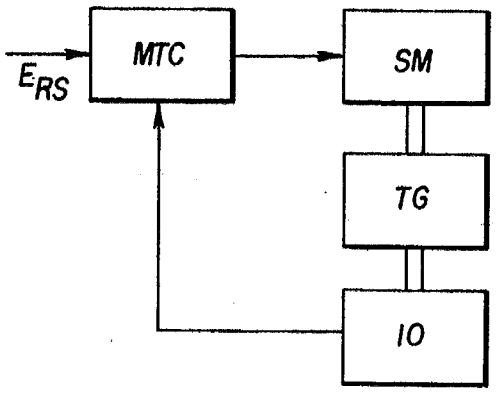
FIGS. 11 and 12 are block diagrams showing other examples of a motor controller.

The motor controller for controlling the speed of the motor M in the above-described embodiments operates to successively control the speed of the motor according to a continuous control system (servo motor system) as shown in FIG. 11; that is, the motor controller comprising a silicon-controlled rectifier or a transistor switch operates to successively control the speed of the motor according to the speed control signal $E_{RS}$ from the operation circuit by using an AC or DC servo motor SM. The use of the DC servo motor is somewhat expensive, but is advantageous in that high response speed can be obtained. The use of the AC servo motor is disadvantageous in that the performance is lowered to an extent; however, the AC servo motor is advantageous in that it is low in price. Accordingly, the motors should be selectively used according to the necessity.

Figure 12:
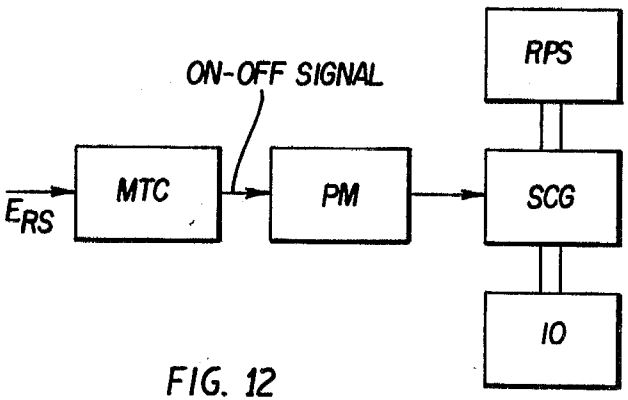

The invention is not limited to the above-described motor controllers. A motor controller according to an intermittent control system (speed change gear system) as shown in FIG. 12 can be employed. In this case, a speed change gear SCG such as a ring cone speed change gear is used for speed control. The speed control signal $E_{RS}$ is converted into an intermittent on-off signal to control the pulse width (PWM) and the number of pulses (PFM) to drive the pilot motor PM of the speed change gear SCG and to change the speed change ratio, whereby the speed is controlled. This system is not so high in response characteristic, but it is advantageous in that it is low in cost.

In the above-described embodiments, the speed of the back rollers is changed by the rotation transmitting mechanism including the variable speed motor M. However, if a speed change gear adapted to combine the constant input shaft of the main draft device 15 and the variable speed input shaft of the pilot motor is employed, then the rotation transmitting mechanism may be so designed that the rotation of the output shaft of the speed change gear is transmitted to the back rollers 10. Furthermore, in the above-described embodiments, the delay circuit is provided after the division circuit which carries out the calculation $E_0/E_1$. However, the delay circuit may be provided after a circuit which carries out a calculation $N F' \times E_0/E_1$, or after the sensor 31. All that is necessary for the delay circuit is to delay the rotation control of the back rollers for a predetermined period of time. Accordingly, in addition to the above-described delay circuits, various delay circuits may be employed.

As is apparent from the above description, even if the apparatus according to the first aspect of the invention is employed for recent, extremely high speed drawing frames or carding or combing machines, the weight unevenness short in wavelength can be effectively corrected, with the result that slivers high in quality are produced.

A sliver weight unevenness correcting apparatus according to the third embodiment (which belongs to the first and second examples of the second aspect of the invention) will be described with reference to FIGS. 1 to 4, 6 to 7 and 13.

The apparatus according to the third embodiment is only different from the first embodiment in the construction of the uneveness correcting circuit and only such differences will be mainly described below. Those components which have been described with reference to the first embodiment will be designated by the same reference numerals and the description thereof will be omitted.

Figure 13:
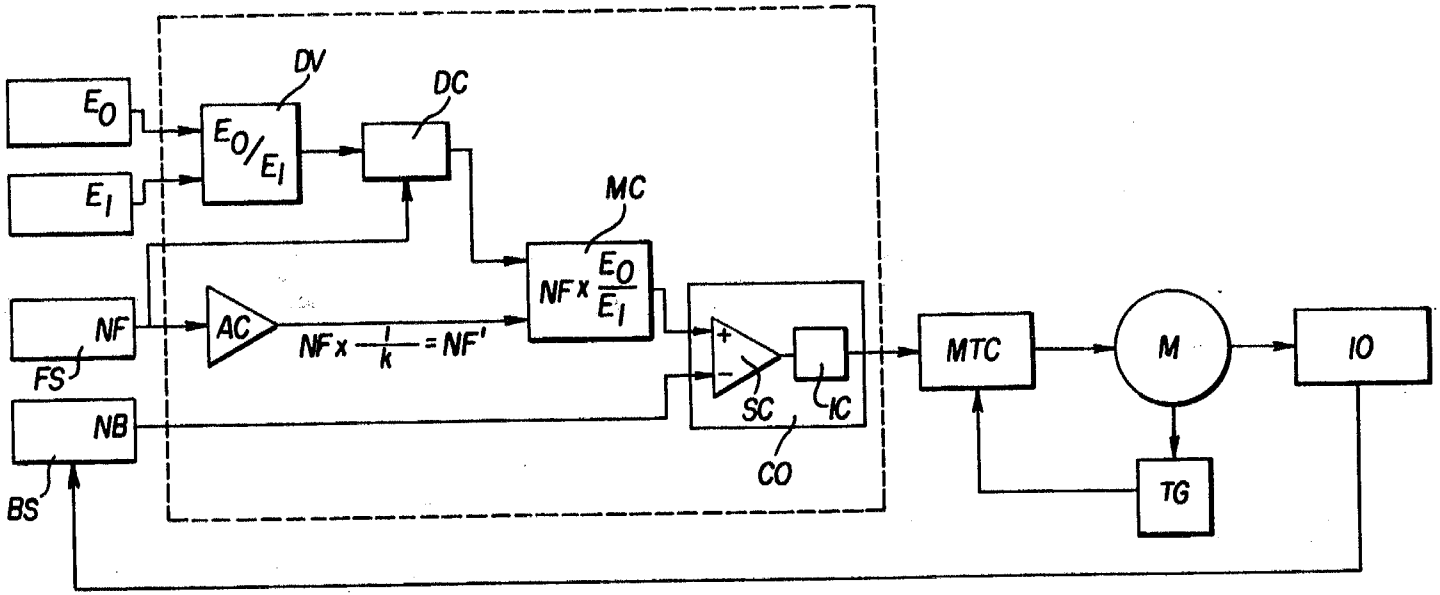
FIG. 13 is a block diagram showing the unevenness correcting circuit according to a third embodiment of the invention.

As shown in FIG. 13, the uneveness correcting circuit OC according to this embodiment is connected to a sensor 31 for detecting displacement of the pressing roller 7 in the sliver weight measuring section 8, a first rotation sensor $F_S$ for detecting the revolutions per minute of the front rollers 11 and a second rotation sensor $B_S$ for detecting the revolutions per minute of the back rollers 10. The uneveness correcting circuit OC comprises: a divider DV; an amplifier AC; a multiplier MC; a delay circuit DC for delaying a signal for a period of time corresponding to the revolutions per minute of the front rollers 11; and a comparison circuit CO for compensating the revolutions per minute of the back rollers 10, the circuit OC being further connected to a speed control circuit MTC. The divider DV operates to subject the output of the sensor 31, i.e., a detection value $E_1$ based on the weight of slivers which have passed and a preset value $E_0$ corresponding to the reference weight of slivers to comparison ($E_0/E_1$). Then, in the multiplier MC, a value ($N_F' (=N_B) - N_F \times (1/$reference draft value $(=k))$), corresponding to the revolutions per minute $N_B$ of the back rollers 11, which is obtained by multiplying the revolutions per minute $N_F$ of the front rollers 11, which is the output of a first rotation sensor $F_S$, by the inverse number of the reference draft value, is mulitplied by the aforementioned value ($E_0/E_1$). As a result, themultiplier MC outputs a control signal $(E_0/E_1) \times (N_F/K)$.

The delay circuit is employed in this embodiment, as in the first embodiment (FIGS. 6 and 7), so that the value ($E_0/E_1$) is applied to the multiplier MC with a predetermined delay time to delay the operation of the correcting draft device until the time instant when the slivers to be measured reach the back rollers 10. The delay time is set in association with the revolutions per minute of the front rollers 11.

Then, in the comparison circuit CO, the difference between the output $(E_0/E_1) \times (N_F/k)$ of the multiplier MC and the revolutions per minute $N_B$ of the back rollers 10 outputted by a second rotation sensor $B_S$ is detected to output a signal corresponding to the difference. The comparison circuit CO comprises a subtractor SC constituted by a differential type operational amplifier and an intergrator IC. The subtractor SC comprises the differential type operational amplifier as shown in FIG. 13. The positive input terminal of the operational amplifier is connected to the output terminal of the above-described multiplier MC to receive the signal $(E_0/E_1)\times(N_F\times k)$, and the negative input terminal thereof is connected to the second rotation sensor to receive the speed signal $N_B$ of the back rollers 10, so that the operational amplifier outputs the difference $(E_0/E_1)\times(N_F/k)-N_B$ between the two input signals. The integration circuit IC integrates the difference signal $(E_0/E_1)\times(N_F/k)-N_B$ ($\Delta N$) outputted by the subtractor SC to provide an integration output which is applied to the motor controller serving as the speed control circuit and to the variable speed motor. The signal is then applied to the back rollers 10 through the transmission mechanism 13.

When the output $\Delta N$ of the subtractor SC is positive, i.e., when the actual revolutions per minute $N_B$ of the back rollers 10 is lower than the target revolutions per minute $(E_0/E_1)\times(N_F/k)$ of the back rollers 10 outputted by the multiplier MC, the integrator circuit IC integrates the positive difference signal $\Delta N$ to increase the integration output toward the positive side, thereby to increase the output which is applied to the motor controller, to increase the speed of the motor M. When the difference signal $\Delta N$ reaches zero, the integration circuit stops the integration, thereby to retain the speed of the motor M, i.e., the speed of the back rollers 10. On the other hand, when the difference signal $\Delta N$ is negative, i.e., when the actual revolutions per minute $N_B$ of the back rollers 10 is higher than the target revolutions per minute of the back rollers 10, the subtractor SC outputs a negative difference signal $\Delta N$. Therefore, the integration output of the integration circuit IC is decreased to decrease the speed of the back rollers thereby to cause the difference signal $\Delta N$ to gradually approach zero. When the difference signal $\Delta N$ reaches zero, the speed of the back rollers is retained. As is apparent from the above description, the comparison circuit CO operates to compensate the speed of the back rollers 10 so that the difference signal $\Delta N$ is zero at all times, i.e., the actual revolutions per minute $N_B$ of the back rollers is equal to the target revolutions per minute $(E_0/E_1)\times(N_F/k)$ at all times. The rotation of the back rollers 10 is controlled in accordance with the instruction at all times, and therefore the draft correction can be carried out with excellent response and high accuracy.

In the case of the feed forward system, the slivers passed through the uneveness correcting draft device 12 are not subjected to weight uneveness measurement, and therefore it is strongly demanded that the draft device 12 operates as instructed by the measuring section 8. In this connection, according to this embodiment, the speed of the back rollers 10 in the draft device 12 is detected to be fed back to the speed control circuit, as a result of which the speed of the back rollers 10 is changed as instructed at all times, which improves the weight uneveness correction accuracy. Therefore, in association with the characteristic of the feed forward system, the correction of the sliver weight uneveness short in wavelength can be effected with higher accuracy even in the case of slivers running at high speed.

The apparatus according to the third embodiment of the invention has various other merits similar to those of the first embodiment described above.

In the third embodiment, the comparison circuit comprises the subtractor constituted by the differential type operational amplifier and the integration circuit; however, it should be noted that the invention is not limited thereto or thereby. That is, other circuits may be employed if they can provide the same effect. For instance, an adder may be employed if the signs of the two input signals representative of the target revolutions per minute $(E_0/E_1)\times(N_F/k)$ and the actual revolutions per minute $N_B$ are changed.

Furthermore, in this embodiment, the delay circuit is such that the delay time is controlled according to the speed of the front rollers; however, the invention is not limited thereto or thereby. That is, a method in which the delay time is maintained unchanged may be employed, or a method may be utilized in which the delay time is controlled in accordance with the speed of the back rollers 10, similarly to the second embodiment as shown in FIG. 8. The latter method is advantageous in that the sliver unevenness correction can be carried out with high accuracy because the delay time is controlled in accordance with the speed of the back rollers 10 which is variable.

In this embodiment, various modifications are possible, similarly to the above-described first and second embodiments, with respect to the construction (FIGS. 9 and 10) and position of the delay circuit, the system (FIGS. 11 and 12) of the motor controller and the construction of the rotation transmitting mechanism.

A sliver weight unevenness correcting apparatus according to the forth embodiment (which belongs to the third aspect of the invention) will be described with reference to FIGS. 1 to 6.

In the apparatus shown in FIGS. 1 to 6, it is desirable that the slivers run at a variable speed until they reach the correcting draft device 12 because the device 12 is rotating at a variable speed. For this purpose, according to this embodiment, the grooved roller 6 of the measuring section 8 and the feeding rollers 2 are connected in drive transmitting relationship with the back rollers 10 of the draft device 12. More specifically, a timing belt 36 is made to run upon a timing pulley 34 of one back roller 10 and a timing pulley 35 mounted to the shaft 18. On the other hand, a timing belt 39 is made to run upon a timing pulley 37 mounted to the shaft 18 and a timing pulley 38 mounted to the shaft of one guide roller 3. Moreover, one guide roller 3 and one feeding roller 2, and two adjacent feeding rollers 2 are likewise connected by means of timing pulleys 40 and 41 and a timing belt 42. As a result, in synchronism with the rotation of the back rollers 10 which are turned at a variable speed in response to the signal from the measuring section 8, the grooved roller 6, the guide rollers 3 and the feeding rollers 2 are also turned at a variable speed so that the slivers can be strictly prevented from being slackened or extended because the tension is maintained at a constant.

Incidentally, although the guide rollers 3 are used to positively introduce the bundled slivers, they may be omitted if two feeding rollers 2 are vertically provided for positively introducing each sliver from the can. Moreover, the means for the driving connection need not be the timing pulleys and the timing belts, but other mechanisms such as gears may be employed. Still further, although in the shown embodiment, the variable rotation is transmitted to the back rollers through the rotation transmitting mechanism including the variable speed motor M, the rotation transmitting mechanism may alternatively be modified such that a speed change gear for coupling the constant speed input shaft from a main draft device 15 and the variable speed input shaft from a pilot motor is adopted to transmit the rotation of the output shaft of the speed change gear to the back rollers 10.

According to this embodiment, the tension of the slivers running from the creel to the correcting draft device can always be maintained constant so that the unevenness correcting function can be further improved.

A sliver weight unevenness correcting apparatus according to the fifth embodiment (which belongs to the fourth aspect of the invention) will be described with reference to FIGS. 14 to 17.

Figure 14:
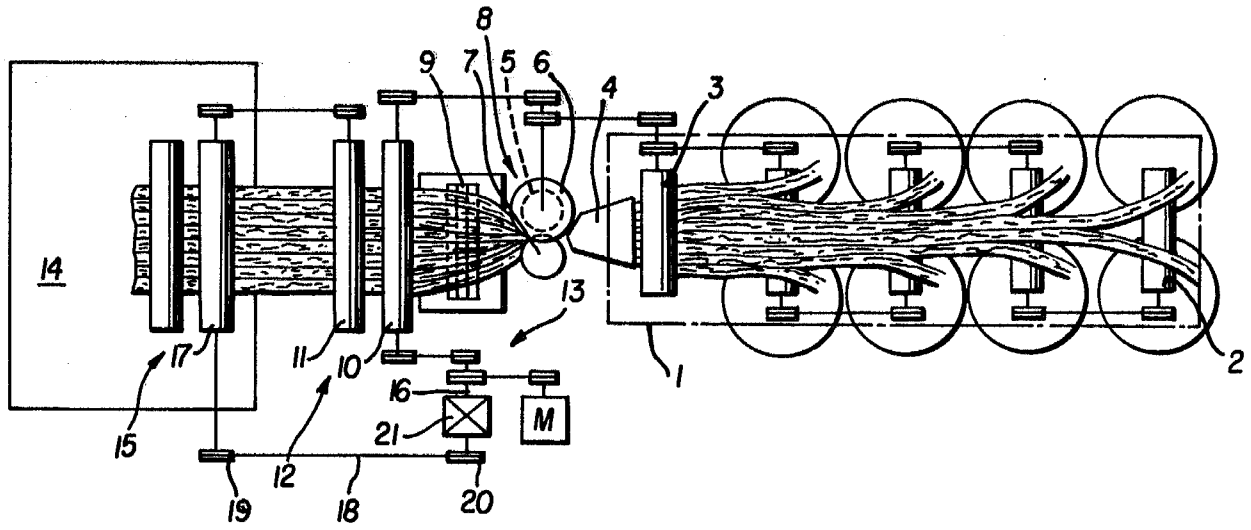
Figure 15:
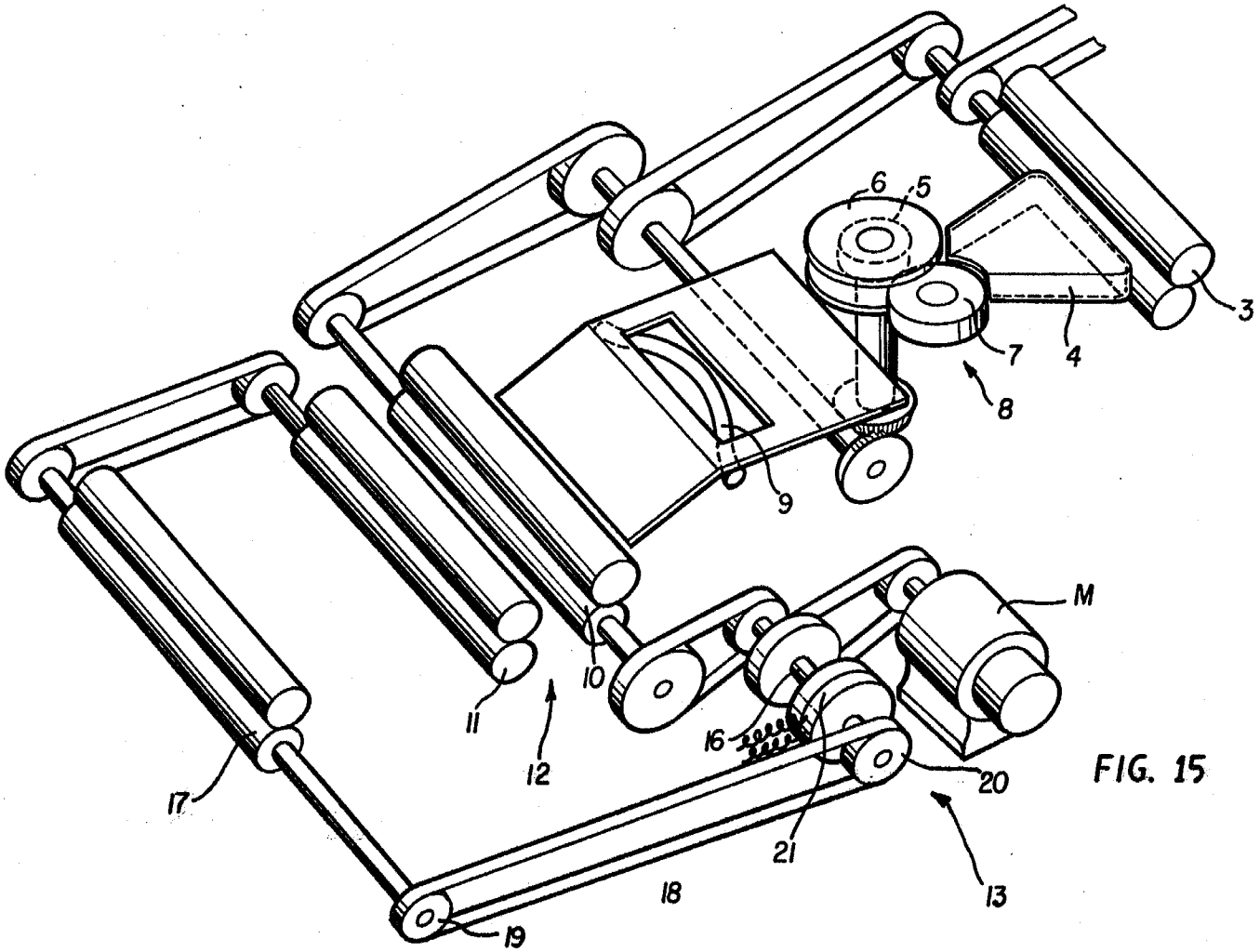

The apparatus shown in FIGS. 14 and 15 is similar to that shown in FIGS. 1 and 2 except that the clutch means is provided within the variable speed rotation transmitting mechanism driven by an independnet motor, for preventing breaking and slackening of the slivers during the starting, interrupting and inching operations. Here, only the differences will be mainly described.

In a correcting draft device driven by an independent motor, a variable speed rotation from a variable speed motor M (i.e. the independent motor to which the signal representative of displacement of the pressing roller 7 is applied) is transmitted to the back rollers 10 through the trasmission mechanism 13. On the other hand, a rotation is transmitted to the front rollers 11 from the back rollers 47 of the main draft device 15 of the drawing frame body 14. The back rollers 10 have a characteristic that they rotate following the front rollers 11 (which rotate faster than the back rollers 10) with a reference drafting ratio. Due to such characteristic, the rotation of the back rollers 10 cannot sufficiently follow the rotation of the front rollers 11 during the stopping, interrupting and inching operations. As a result, the slivers are liable to be broken during the starting operation between the front rollers 11 and the back rollers 10 and to be slackened during the interrupting operation.

Figure 16:
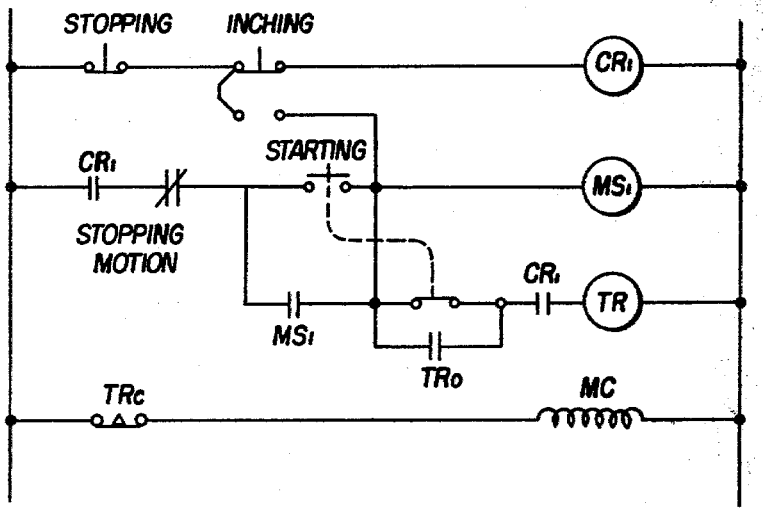

In order to eliminate such phenomena, according to this embodiment an electromagnetic clutch 51 acting as clutch means, which is connected to the back rollers 47 of a main draft device 15 by means of a timing belt 48 and timing pulleys 49 and 50, is mounted on a rotary shaft 46 in the variable speed rotation transmitting mechanism 13, as shown in FIGS. 14 and 15. According to this construction, since the contact TRc of a timer TR is closed under an initial conditions, as shown in FIG. 16, a clutch coil MC is supplied with an electric power so that the front rollers 11 and the back rollers 10 are engaged at a reference drafting ratio. For the starting operation, a starting button is pushed and a main motor relays $MS_1$ for the drawing frame body 14 is excited to start the motor M. Then, a timer relay TR is operated to initiate the counting operation and to simultaneously close a switch TRo. Since the contact TRc is kept closed until the timer ends its counting operation, the clutch coil MC is supplied with the electric power so that the starting operation is performed under the condition that the back rollers 10 are engaged at the reference drafting ratio with the main draft device 15, i.e., the front rollers 11. If the set time of the timer is made longer than that required for the main draft device 15 to reach its normal rotating condition, the front rollers 11 restore at the end of the counting operation, to their normal rotating condition, and the contact TRc is simultaneously turned "OFF". As a result, the clutch coil MC is deenergized so that the back rollers 10 are driven by the variable speed motor M only and are brought into a state ready for unevenness correction. More specifically, during the preset time until the normal rotating condition is reached after reception of the starting instruction, i.e., during the preset time of the timer TR, both the front and back rollers 11 and 10 are simultaneously rotationally driven by the back rollers 47 of the main draft device 15 so that the slivers can be prevented from being cut and slackened, and are only supplied with the draft resulting from the difference between the surface speeds. When the aforementioned timer TR reaches its preset time, the clutch coil MC is deenergized to release the electromagnetic clutch 51. After that, the rotations are transmitted to the back rollers 10 through the variable speed rotation transmitting mechanism 13 from the motor M which has its speed varied in response to the electric signals based upon the instruction of the measuring section 8.

During the inching operation, on the other hand, the clutch coil MC is kept energized irrespective of the "ON" and "OFF" of an inching switch, and the clutch 51 is brought into rotational engagement with the main draft device 15 so that the front rollers 11 and the back rollers 10 are operated to effect inching at the reference drafting ratio thereby to make it possible to accomplish the normal sliver forwarding operation.

Upon the interrupting operation, a relay $CR_1$ is released from its energized condition by pushing the interrupting button, and the main motor relay $MS_1$ is also released. As a result, the rotations of the drawing frame body 14 are brought into their coasting mode, and the timer relay TR is deenergized so that the clutch coil MC is energized to effect engagement of the electromagnetic clutch 51. As a result, the coasting rotations of the drawing frame body 14 are transmitted through the clutch 51 to the rotation transmitting mechanism 13 so that the rotations are transmitted to the back rollers 10 of the correcting draft device 12. Thus, no variation in the drafting ratio between the front rollers 11 and the back rollers 10 will take place until the complete interruption.

In these ways, the two rollers 10 and 11 of the correcting draft device 12 are turned absolutely synchronously during the preset time period after reception of the starting instruction upon the starting operation, and especially the back rollers 10 will not initiate their rotations with a delay so that the slivers are prevented from being cut. After reception of the interrupting instruction, on the other hand, the both rollers 10 and 11 are turned synchronously until the complete interruption, and especially the back rollers 10 will not be interrupted with a delay, thereby to obviate the undesired phenomena that the slivers are slackened. During the inching operation, moreover, it is possible to obviate the phenomena that the slivers are cut and slackened.

Figure 17:
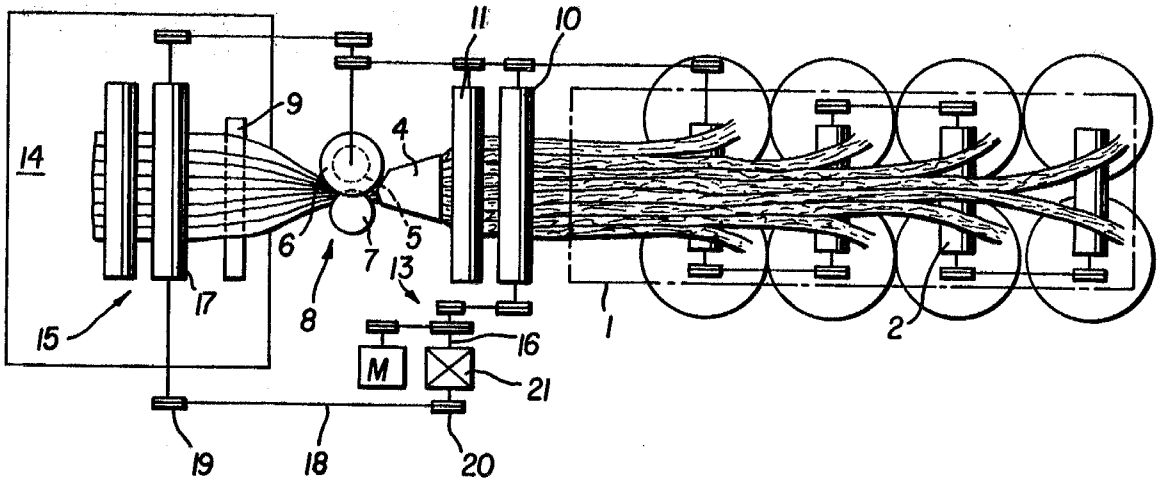

The example shown in FIG. 17 is directed to the sliver weight unevenness correcting apparatus of the feedback system. In this apparatus, the back rollers 10, to which the rotations are transmitted from the variable speed motor M operable to rotate at a variable speed in response to the instruction from the measuring section 8, also rotate following the front rollers 11, to which the rotations at the constant speed are trasmitted from the main draft device 15 of the drawing frame body 14. During the starting operation, the slivers are liable to be cut by the excessive draft between the two rollers 10 and 11. During the interrupting operation, moreover, the slivers are liable to be slackened between the two rollers 10 and 11.

In order to obviate such undesired phenomena, the electromagnetic clutch 51 is attached to the rotary shaft 46 in the variable speed rotation transmitting mechanism 13 and is connected to the back rollers 47 of the main draft device 15 through the timing belt 48 and through the timing pulleys 49 and 50. Similarly to the embodiment shown in FIG. 14, the electromagnetic clutch 51 thus connected is also brought into engagement in response to the starting instruction to transmit the rotations of the drawing frame body 14 to the back rollers 10 so that the back rollers 10 are turned for a preset time in synchronism with the front rollers 11 to which the rotations are transmitted from the drawing frame body 14. As a result, the phenomena that the slivers are cut due to the delay in the start of the back rollers 10 will not take place. Even in the case of the interruption, the clutch 51 is also engaged in response to the interrupting instruction to continue the engagement during the time until the complete interruption so that the back rollers can be interrupted in synchronism with the front rollers 11, thereby to prevent the slivers from being slackened due to the delayed interruption of the back rollers 10.

As has been described hereinbefore, according to the fourth aspect of the present invention, at least the back rollers of the correcting draft device are driven by the independent motor, and the clutch is applied so that the back rollers are made synchronous with the drive of the main draft device during the abruptly changing time of the rotations, i.e., during the preset time after the start and before the interruption and during the inching operation. As a result, the phenomena that the slivers are cut and slackened will not take place. Although the unevenness correcting function is interrupted while the clutch is being applied, the time period is so short, because it corresponds to the rotational delay time of the back rollers relative to the rotation of the front rollers of the main draft device, that the length of passage of the slivers during such time is extremely short. Moreover, the mechanism is so simple and practical because the clutch means is merely incorporated into the variable speed rotation transmitting mechanism.

Although, in the foregoing description, the electromagnetic clutch is used as the clutch means, the present invention should not be limited thereto but can employ all clutch means such as a mechanical clutch or a hydraulic clutch if they have such a control function as can effect the clutch application for a preset time and release thereafter.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Sliver weight unevenness correcting apparatus comprising:

a sliver weight measuring section having a sliver weight detecting sensor for detecting the variations in weight of a bundle of slivers;

a correcting draft device having front rollers disposed downstream of said sliver weight measuring section relative to the direction of advancement of slivers, said front rollers being rotated at a constant speed, and back rollers disposed between said sliver weight measuring section and said front rollers, said back rollers being rotated at a variable speed;

rotation detecting means for detecting the number ($N_F$) of revolutions of said front rollers;

an unevenness correcting circuit having a ratio circuit for operating a ratio ($E_0/E_1$) between a reference weight ($E_0$) of the bundle of slivers and a detected weight ($E_1$) thereof, and a contrasting operational circuit for multiplying said operational ratio ($E_0/E_1$) from said ratio circuit and a ratio ($N_F/k$) between the number ($N_F$) of revolutions of said front rollers from said rotation detecting means and a reference draft value (k), and for producing a multiplied signal ($E_0/E_1 \cdot N_F k$); and a speed control circuit for producing a speed control signal responsive to the multiplied signal ($E_0/E_1 \cdot N_F/k$) from said contrasting operational circuit, said speed control circuit connected with the back rollers via a rotation transmitting mechanism, thereby controlling the speed of rotation of said back rollers through the rotation transmitting mechanism.

2. Sliver weight unevenness correcting apparatus according to claim 1, further comprising :

a delay circuit for delaying the speed control of said back rollers for a predetermined period of time.

3. Sliver weight unevenness correcting apparatus according to claim 2, wherein:

said delay circuit has means for delaying the speed control of said back rollers for a predetermined constant period of time by taking into account the distance between said sliver weight measuring section and said correcting draft device as well as the sliver running speed in said correcting draft device.

4. Sliver weight unevenness correcting apparatus according to claim 2, wherein:

said delay circuit has means for delaying the speed control of said back rollers for a predetermined period of time in response to the speed of said front rollers in said correcting draft device, thereby eliminating the trouble of changing the speed of said front rollers whenever required.

5. Sliver weight unevenness correcting apparatus according to claim 2, further comprising:

second rotation detecting means for detecting the number ($N_B$) of revolutions of said back rollers of said draft correcting device; and wherein said delay circuit has means for delaying the speed control of said back rollers for a predetermined period of time in response to the speed of said back rollers in said correcting draft device, whereby the sliver weight unevenness correction is effected with high accuracy.

6. Sliver weight unevenness correcting apparatus accordng to claim 1, further comprising:

second rotation detectng means for detecting the number ($N_B$) of revolutions of said back rollers of said draft correcting device; and a comparison circuit connected to said second rotation detecting means, for detecting the difference ($E_0/E_1 \cdot N_F/k - N_B$) between the multiplied signal ($E_0/E_1 \cdot N_F/k$) from said contrasting operational circuit and the number ($N_B$) of revolutions of said back rollers from said second rotation detecting means; and wherein said speed control circuit produces a speed control signal responsive to the difference ($E_0/E_1 \cdot N_F/k - N_B$) from said comparison circuit.

7. Sliver weight unevenness correcting apparatus according to claim 6, further comprising:

a delay circuit for delaying the speed control of said back rollers for a predetermined period of time.

8. Sliver weight unevenness correcting apparatus according to claim 6, wherein, said comparison circuit comprises:

a subtraction circuit connected to said contrasting operational circuit and said second rotation detecting means, for detecting the difference ($E_0/E_1 \cdot N_F/k - N_B$) between the multiplied signal ($E_0/E_1 \cdot N_F/k$) from said contrasting operational circuit and the number ($N_B$) of revolutions of said back rollers from said second rotation detecting means; and an integration circuit, connected to said subtraction circuit, for integrating the difference signal ($E_0/E_1 \cdot N_F/k - N_B$) from said subtraction circuit, and for producing an integrated signal; and said speed control circuit has means for producing a speed control signal responsive to the integrated signal from said integration circuit, whereby the control is effected with high response and high accuracy.

9. Sliver weight unevenness correcting apparatus according to claim 1, wherein:

said sliver weight measuring section has a grooved roller with a groove adapted to surround slivers, and a pressing roller which is fitted into the groove of said grooved roller and is displaced in accordance with the variations in weight of the bundle of slivers.

10. Sliver weight unevenness correcting apparatus according to claim 9, wherein:

said back rollers of said correcting draft device are connected in a drive transmitting relationship with said rotation transmitting mechanism, and are further connected in a drive transmitting relationship with said grooved roller of said sliver weight measuring section, and with feeding rollers disposed upstream of said sliver weight measuring section.

11. Sliver weight unevenness correcting apparatus according to claim 1, wherein:

said rotation transmitting mechanism has an independent motor, and said back rollers of said correcting draft device are connected in a drive transmitting relationship with said rotation transmitting mechanism;

a main draft device having a rotational source is disposed downstream of said correcting draft device; and clutch means is interposed between said rotation transmitting mechanism and said rotational source, positively connecting in a drive transmitting relationship with said back rollers of said correcting draft device and said rotational source of said main draft device through said rotation transmitting mechanism during a preset time period for starting and interrupting operations, and during an inching operation, thereby preventing breaking and slackening of the slivers during these operations.

12. Sliver weight unevenness correcting apparatus according to claim 1, further comprising:

a creel device having a plurality of feeding rollers for feeding a plurality of slivers parallel to one another;

a collector, for collecting a plurality of slivers, disposed downstream of said creel device;

an expanding device, for expanding and arranging the bundle of collected slivers in parallel with one another again, disposed downstream of said collector; and a main draft device disposed downstream of said expanding device, and wherein said sliver weight measuring section is provided between said collector and said expanding device, and has a grooved roller with a groove adapted to surround slivers, and a pressing roller which is fitted into said groove of said grooved roller and is displaced in accordance with the variations in weight of a bundle of slivers; and said correcting draft device is provided between said expanding device and said main draft device.

13. Sliver weight unevenness correcting apparatus according to claim 12, wherein:

said grooved roller and pressing roller are disposed with their axes in perpendicular relationship to the longitudinal direction of said feeding rollers of said creel device, and said front and back rollers of said correcting draft device;

said sliver weight detecting sensor comprises a magnetic element provided on a protrusion formed in the vicinity of a base of a swinging support arm on which said pressing roller is rotatably supported; and a magnetoelectric conversion element is provided at a stationary position slightly spaced from said magnetic element, thereby detecting variations in weight of a bundle of slivers as the variation of a coincident area of confronted surfaces of both elements.

14. Sliver weight unevenness correcting apparatus according to claim 13, further comprising:

a delay circuit for delaying the speed control of said back rollers for a predetermined period of time.

15. Sliver weight unevenness correcing apparatus according to claim 14, wherein:

said delay circuit has means for delaying the speed control of said back rollers for a predetermined period of time in response to the speed of said front rollers in said correcting draft device, thereby eliminating the trouble of changing the speed of said front rollers whenever required.

16. Sliver weight unevenness correcting apparatus according to claim 15, wherein:

said ratio circuit comprises a divider, connected to said sliver weight detecting sensor and to a reference voltage source having a preset value corresponding to the reference sliver weight, for producing the ratio signal ($E_0/E_1$);

said delay circuit comprises a first level adjusting circuit, connected to said divider of said ratio circuit, for adjusting the signal level of the ratio signal ($E_0/E_1$), a clock pulse generating circuit comprising a V-F converter, connected to said first rotation detecting means, for producing a clock pulse signal having a period corresponding to the number ($N_F$) of revolutions of said front rollers, a delay element comprising N delay element units, connected to said first level adjusting circuit and a clock pulse generating circuit, for shifting the ration signal ($E_0/E_1$) from one delay element unit to another whenever the clock pulse signal from said clock pulse generating circuit is applied thereto, and for producing the delayed ratio signal ($E_0/E_1$), and a second level adjusting circuit, connected to said delay element, for adjusting the signal level of the delayed ratio signal ($E_0/E_1$);

an amplifier is connected to said rotation detecting means, for amplifying the revolution signal ($N_F$) of said front rollers by the amplification factor 1/k and producing the amplified signal ($N_F/k$) of the revolution signal ($N_F$);

said contrasting operational circuit comprises a multiplier connected to said delay circuit and said amplifier, for multiplying the delayed ratio signal ($E_0/E_1$) and the amplified signal ($N_F/k$), and for producing the multiplied signal ($E_0/E_1\ N_F/k$); and said speed control circuit comprises a motor controller of a servo motor system connected to said contrasting operational circuit.

17. Sliver weight unevenness correcting apparatus according to claim 16, further comprising:

second rotation detecting means for detecting the number ($N_B$) of revolutions of said back rollers of said draft correcting device; and a comparison circuit comprising a subtraction circuit, connected to said contrasting operational circuit and said second rotation detecting means, for operating the difference ($E_0/E_1 \cdot N_F/k - N_B$) between the multiplied signal ($E_0/E_1 \cdot N_F/k$) from said contrasting operational circuit and the number ($N_B$) of revolutions of said back rollers from said second rotation detecting means, and an integration circuit, connected to said subtraction circuit, for integrating the difference signal ($E_0/E_1 \cdot N_F/k - N_B$) from said subtraction circuit, and for producing an integrated signal, and wherein said speed control circuit produces a speed control signal responsive to the integrated signal from said integration circuit, whereby the control is effected with high response and high accuracy.

18. Sliver weight unevenness correcting apparatus according to claim 17, wherein:

said back rollers of said correcting draft device are connected in a drive transmitting relationship with said rotation transmitting mechanism, and are further connected in a drive transmitting relationship with said grooved roller of said sliver weight measuring section and feeding rollers disposed upstream of said sliver weight measuring section.

19. Sliver weight unevenness correcting apparatus according to claim 18, wherein:

said grooved roller of said sliver weight measuring section is connected in drive transmitting relationship with said back rollers of said correcting draft device through a timing belt made to run upon a timing pulley of one of said back rollers and a timing pulley mounted to a shaft connected in drive transmitting relationship with said grooved roller;

a guide roller of said creel device is connected in drive transmitting relationship with said grooved roller through a timing belt made to run upon a timing pulley mounted to said shaft connected in drive transmitting relationship with said grooved roller and a timing pulley mounted to a shaft of said guide roller; and said feeding rollers of said creel device are connected in drive transmitting relationship with said guide roller through a timing belt made to run upon a timing pulley mounted to said shaft of said guide roller and a timing pulley of said feeding roller.

20. Sliver weight unevenness correcting apparatus according to claim 19, wherein:

said rotation transmitting mechanism has an independent motor, and said back rollers of said correction draft device are connected in a drive transmitting relationship with said rotation transmitting mechanism; and clutch means are interposed between said rotation transmitting mechanism and a rotational source of a main draft device disposed downstream of said correcting draft device and positively connecting in a drive transmitting relationship with said back rollers of said correcting draft device and said rotational source of said main draft device through said rotation transmitting mechanism during a preset time period for the starting and interrupting operations, and during an inching operation, thereby preventing breaking and slackening of the slivers during these operations.

21. Sliver weight unevenness correcting apparatus according to claim 20, wherein:

said clutch means comprises an electromagnetic clutch connected to back rollers of said main draft device by means of a timing belt, a timing pulley mounted to a shaft of said back rollers of said main draft device, and a timing pulley mounted to a shaft of said electromagnetic clutch, and a control circuit comprising a main motor relay with a contact for exciting to start said independent motor, a relay with a contact, a timer relay with a switch and a contact, a clutch coil for energizing said electromagnetic clutch, a manual starting switch, a manual stopping switch, a manual inching switch, and a stopping motion relay for emergency.

22. Sliver weight unevenness correcting apparatus according to claim 14, further comprising:

second rotation detecting means for detecting the number ($N_B$) of revolutions of said back rollers of said draft correcting device, and wherein said delay circuit has means for delaying the speed control of said back rollers for a predetermined period of time in response to the speed of said back rollers in said correcting draft device, whereby the sliver weight unevenness correction is effected with high accuracy.

23. Sliver weight unevenness correcting apparatus according to claim 22, wherein:

said ratio circuit comprises a divider, connected to said sliver weight detecting sensor and to a reference voltage source having a preset value corresponding to the reference sliver weight, for producing the ratio signal ($E_0/E_1$);

said delay circuit comprises a first level adjusting circuit, connected to said divider of said ratio circuit, for adjusting the signal level of the ratio signal ($E_0/E_1$);

a clock pulse generating circuit comprising a V-F converter, connected to said second rotation detecting means, for producing a clock pulse signal having a period corresponding to the number ($N_B$) of revolutions of said back rollers, a delay element comprising N delay element units, connected to said first level adjusting circuit and a clock pulse generating circuit, for shifting the ratio signal ($E_0/E_1$) from one delay element unit to another whenever the clock pulse signal from said clock pulse generating circuit is applied thereto, and for producing the delayed ratio signal ($E_0/E_1$), and a second level adjusting circuit, connected to said delay element, for adjusting the signal level of the delayed ratio signal ($E_0/E_1$);

an amplifier is connected to said rotation detecting means, for amplifying the revolution signal ($N_B$) of said front rollers by the amplification factor 1/k and producing the amplified signal ($N_B/k$) of the revolution signal ($N_B$);

said contrasting operational circuit comprises a multiplier connected to said delay circuit and said amplifier, for multiplying the delayed ratio signal ($E_0/E_1$) and the amplified signal ($N_Bk$), and for producing the multiplied signal ($E_0/E_1N_Bk$); and said speed control circuit comprises a motor controller of a servo motor system connected to said contrasting operational circuit.

24. Sliver weight unevenness correcting apparatus according to claim 23, further comprising:

a comparison circuit having a subtraction circuit, connected to said contrasting operational circuit and said second rotation detecting means, for operating the difference ($E_0E_1 \cdot N_F/k - N_B$) between the mutiplied signal ($E_0/E_1 \cdot N_Fk$) from said contrasting operational circuit and the number ($N_B$) of revolutions of said back rollers from said second rotation detecting means, and an integration circuit, connected to said subtraction circuit, for integrating the difference signal ($E_0/E_1 \cdot N_F/k - N_B$) from said subtraction circuit, and for producing an integrated signal, and wherein said speed control circuit produces a speed control signal responsive to the integrated signal from said integration circuit, whereby the control is effected with high response and high accuracy.

25. Sliver weight unevenness correcting apparatus according to claim 14, wherein:

said delay circuit further comprises an A-D converter, connected to said ratio circuit, for converting the ratio signal ($E_0/E_1$) into a digital signal, a clock pulse generating circuit producing a clock pulse signal in response to the revolution of said front rollers or back rollers, a shift register connected to said A-D converter and said clock pulse generating circuit, and a D-A converter, connected to said shift register, for converting the digital delayed signal into the analog signal.

26. Sliver weight unevenness correcting apparatus according to claim 14, wherein:

said delay circuit further comprises a tape recorder employing an endless magnetic tape.

27. Sliver weight unevenness correcting apparatus according to claim 26, wherein:

said tape recorder has a recording head and a reproducing head and the distance between the recording head and reproducing head in the tape recorder is controlled in response to the revolutions of said front rollers or back rollers.

28. Sliver weight unevenness correcting apparatus according to claim 26, wherein:

the running speed in said tape recorder is controlled in response to the revolutions of said front rollers or back rollers.

29. Sliver weight unevenness correcting apparatus according to claim 14, wherein:

said speed control circuit comprises a motor controller according to a continuous control system.

30. Sliver weight unevenness correcting apparatus according to claim 14, wherein:

said speed control circuit comprises a motor controller according to an intermittent control system.

* * * * *